US009241216B2

(12) United States Patent
Keiler et al.

(10) Patent No.: US 9,241,216 B2
(45) Date of Patent: Jan. 19, 2016

(54) DATA STRUCTURE FOR HIGHER ORDER AMBISONICS AUDIO DATA

(75) Inventors: Florian Keiler, Hannover (DE); Sven Kordon, Wunstorf (DE); Johannes Boehm, Goettingen (DE); Holger Kropp, Wedemark (DE); Johann-Markus Batke, Hannover (DE)

(73) Assignee: Thomson Licensing, Issy les Moulineaux (FR)

( * ) Notice: Subject to any disclaimer, the term of this patent is extended or adjusted under 35 U.S.C. 154(b) by 198 days.

(21) Appl. No.: 13/883,094

(22) PCT Filed: Oct. 26, 2011

(86) PCT No.: PCT/EP2011/068782

§ 371 (c)(1), (2), (4) Date: May 2, 2013

(87) PCT Pub. No.: WO2012/059385

PCT Pub. Date: May 10, 2012

(65) Prior Publication Data

US 2013/0216070 A1 Aug. 22, 2013

(30) Foreign Application Priority Data

Nov. 5, 2010 (EP) ..... 10306211

(51) Int. Cl.

| | |
|---|---|
| ***H04R 5/02*** | (2006.01) |
| ***G10L 19/008*** | (2013.01) |
| ***H04S 3/00*** | (2006.01) |

(52) U.S. Cl.

CPC ..... *H04R 5/02* (2013.01); *G10L 19/008* (2013.01); *H04S 3/00* (2013.01); *H04S 2420/11* (2013.01)

(58) Field of Classification Search

CPC ..... G10L 19/008; H04S 3/00; H04S 2420/11
USPC ..... 381/300
See application file for complete search history.

(56) References Cited

U.S. PATENT DOCUMENTS

| | | | |
|---|---|---|---|
| 4,042,779 | A | 8/1977 | Craven et al. |
| 5,956,674 | A | 9/1999 | Smyth et al. |
| 2003/0147539 | A1 | 8/2003 | Elko et al. |

(Continued)

FOREIGN PATENT DOCUMENTS

| | | | |
|---|---|---|---|
| CN | 1495705 | A | 6/1997 |
| CN | 1677490 | | 10/2005 |

(Continued)

OTHER PUBLICATIONS

Dobson R.W., "Developments in Audio File Formats" Proceedings, ICMC 2000, editor. Ioannis Zannos, ICMA, Aug. 30, 2000, pp. 1-4.

(Continued)

*Primary Examiner* — Sonia Gay

(74) *Attorney, Agent, or Firm* — Robert D. Shedd; Chris Kolefas

(57) ABSTRACT

The invention is related to a data structure for Higher Order Ambisonics HOA audio data, which data structure includes 2D or 3D spatial audio content data for one or more different HOA audio data stream descriptions. The HOA audio data can have on order of greater than '3', and the data structure in addition can include single audio signal source data and/or microphone array audio data from fixed or time-varying spatial positions.

14 Claims, 9 Drawing Sheets

(56) References Cited

U.S. PATENT DOCUMENTS

Figure 1:
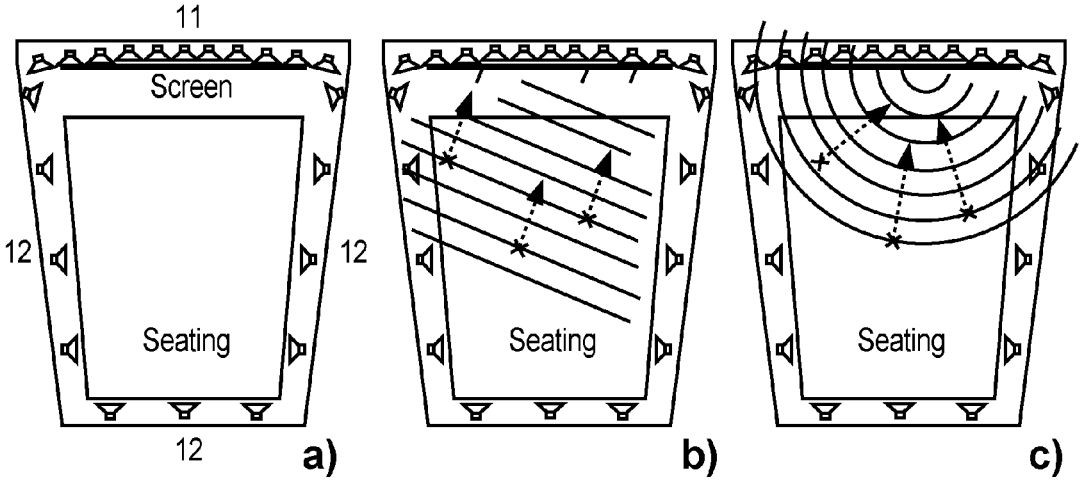

| | | | | |
|---|---|---|---|---|
| 2008/0107276 | A1* | 5/2008 | Ichimura | 381/1 |
| 2011/0305344 | A1 | 12/2011 | Sole et al. | |

FOREIGN PATENT DOCUMENTS

| | | | |
|---|---|---|---|
| CN | 101872618 | | 10/2010 |
| EP | 2205007 | A1 | 7/2010 |
| EP | 2451196 | | 5/2012 |
| JP | 2012514358 | | 6/2012 |
| WO | WO9721211 | | 6/1997 |
| WO | WO03061336 | | 7/2003 |

OTHER PUBLICATIONS

"A First Proposal to Specify, Define and Determine the Parameters for an Ambisonics Exchange Format", http://ambisonics.iem.at/xchange/format/a-first-proposal-for-the-format, Oct. 12, 2010, pp. 1-4.

"Existing Formats", http://ambisonics.iem.at/xchange/format/existing-formats, Oct. 12, 2010, pp. 1-3.

"File Format for B-Format" http://www.ambisonia.com/Members/mleese/file-forma-for-b-format, Oct. 12, 2010, p. 1.

Travis C, Four Candidate Component Sequences VO.9; pp. 1-7; 2008 Accessed on line 2008: http://ambisonics.googlegroups.com/web/Four+candidate+component+sequences+V09.PDF.

Malham, 3D Ascoustic Space and its simulation using Ambisonics; Music Research Center, University of York, UK; pp. 1-27; 2007.

Shtools—Real Spherical Harmonics, Tools for Working with Spherical Harmonics, pp. 1-3; Centre National del la Recherche Scientifique, Institute de Physique du Globe de Paris; c 2009 Mark Wieczorek.

Poletti, MA: Three-dimensional surround sound systems based on spherical harmonics; J. Audio Engineering Society, Industrial Resource Ltd., Nov. 2005; pp. 1-22, vol. 53, No. 11; Lower Hutt, New Zealand.

IEEE.IEEE Standard for Binary Floating Point Arithmatic; Ed. 754-2010; pp. 1-2; 2008 Accessed on line Sep. 16, 2010: http://grouper.ieee.org/groups/754/.

Daniel, Spatial Sound Encoding Including Near Field Effect: Introducing Distance Coding Filters and a Viable, new Ambisonic Format; May 2003, pp. 1-15; AES 23rd International Conference, Copenhagen, Denmark.

Princen etal, Analysis/Synthesis Filter Bank Design Based on Time Domain Aliasing Cancellation; IEEE Transactions on Acoustics, Speech, and Signal Processing; Oct. 1996, pp. 1153-1161, vol. ASSP-34, No. 5.

Dobson R.W., "Developments in Audio File Formats" Proceedings, ICMC 2000, ed. Ioannis Zannos, ICMA, Aug. 2000. http://people.bath.ac.uk/masrwd/Dobson-FileFormats-ICMC2000.pdf.

Daniel et al., "Further Investigations of High Order Ambisonics and Wavefield synthesis for Holophonic Sound Imaging", Convention Paper 5788, 114th AES Convention, Audio Engineering Society, Mar. 22, 2003.

Miller R E., Scalable Tri-Play Recoding for Stereo, ITU 5.16.1 2D, and Periphonic 3D (with Height) Compatible Surround Sound Reproduction, 115th AES Convention, Audio Engineering Society, Oct. 10, 2003.

Search Report dated Dec. 29, 2011.

Jérôme Daniel. Représentation de champs acoustiques, application à la transmission et à la reproduction de scèenes sonores complexes dans un contexte multimédia. PhD thesis, Université Paris 6, Jul. 31, 2001.

Earl G. Williams. Fourier Acoustics. Academic Press, Chapter 6, Spherical Waves, pp. 183-196; 1999.

Michael Chapman, Winfried Ritsch, Thomas Musil, Johannes Zmölnig, Hannes Pomberger, Franz Zotter, and Alois Sontacchi. A standard for interchange of ambisonic signal sets including a file standard with metadata. In Proceedings of the Ambisonics Symposium 2009, Jun. 25, 2009.

ISO/IEC JTC1/SC29. Information technology—coding of audio-visual objects—part 11: Scene description and application engine. Technical Specification, 2005. MPEG-4 ISO/IEC FDIS 14496-11:2005(E). renewed: 2014.

Dave Malham "Higher order ambisonic systems", Mphil thesis Space in Music-Music in Space, University of York, Apr. 1, 2003.

Dave Malham "Second and third order ambisonics—the Furse-Malham set", Official date: Feb. 14, 2005, Online Retrieved: http://www.york.ac.uk/inst/mustech/3d_audio/secondor.html, retrieved Aug. 7, 2015.

Mark Poletti. "Unified description of ambisonics using real and complex spherical harmonics", In Proceedings of the Ambisonics Symposium 2009, Graz. Austria, Jun. 25, 2009.

William H. Press, Saul A. Teukolsky, William T. Vetterling, and Brian P. Flannery. Numerical Recipes in C. Cambridge University Press, Jan. 1, 1992.

Anonymous "Spherical harmonics", online retrieved from: http://en.citizendium.org/wiki/Spherical_harmonics, date of retrieval: Aug. 7, 2015.

Anonymous, Wikipedia, "Associated Legendre polynomials", retrieved from: http://en.wikipedia.org/w/index.php?title=Associated_Legendre_polynomials&oldid=363001511, 2010. Online, accessed Sep. 16, 2010.

Gerzon, "General metatheory of auditory localization", In 92th AES Convention, An Audio Engineering Society, Vienna, Austria, Mar. 24, 1992. Preprint 3306.

Etienne Deleflie, "Universal ambisonic v0.97", online retrieved from: http://docs.google.com/Doc? id=df4dtw69_81dsgmgqc3&h1=en, date of document: Nov. 26, 2010, date of retrieval: Aug. 10, 2015.

Jens Ahrens and Sascha Spors. Analytical driving functions for higher order ambisonics. In Proceedings of the ICASSP, pp. 373-376, Jan. 1, 2008.

* cited by examiner

DATA STRUCTURE FOR HIGHER ORDER AMBISONICS AUDIO DATA

The invention relates to a data structure for Higher Order Ambisonics audio data, which includes 2D and/or 3D spatial audio content data and which is also suited for HOA audio data having on order of greater than '3'.

BACKGROUND

3D Audio may be realised using a sound field description by a technique called Higher Order Ambisonics (HOA) as described below. Storing HOA data requires some conventions and stipulations how this data must be used by a special decoder to be able to create loudspeaker signals for replay at a given reproduction speaker setup. No existing storage format defines all of these stipulations for HOA. The B-Format (based on the extensible 'Riff/way' structure) with its *.amb file format realisation as described as of 30 Mar. 2009 for example in Martin Leese, "File Format for B-Format", http://www.ambisonia.com/Members/etienne/Members/mleese/flle-format-for-b-format, is the most sophisticated format available today. The .amb file format was presented in 2000 by R. W. Dobson, "Developments in Audio File Formats", at ICMC Berlin 2000.

As of 16 Jul. 2010, an overview of existing file formats is disclosed on the Ambisonics Xchange Site: "Existing formats", http://ambisonics.iem.at/xchange/format/existing-formats, and a proposal for an Ambisonics exchange format is also disclosed on that site: "A first proposal to specify, define and determine the parameters for an Ambisonics exchange format", http://ambisonics.iem.at/xchange/format/a-first-proposal-for-the-format.

Invention

Regarding HOA signals, for 3D a collection of $M=(N\pm1)^2$ ((2N+1) for 2D) different Audio objects from different sound sources, all at the same frequency, can be recorded (encoded) and reproduced as different sound objects provided they are spatially even distributed. This means that a 1st order Ambisonics signal can carry four 3D or three 2D Audio objects and these objects need to be separated uniformly around a sphere for 3D or around a circle in 2D. Spatial overlapping and more then M signals in the recording will result blur—only the loudest signals can be reproduced as coherent objects, the other diffuse signals will somehow degenerate the coherent signals depending on the overlap in space, frequency and loudness similarity.

Regarding the acoustic situation in a cinema, high spatial sound localisation accuracy is required for the frontal screen area in order to match the visual scene. Perception of the surrounding sound objects is less critical (reverb, sound objects with no connection to the visual scene). Here the density of speakers can be smaller compared to the frontal area.

The HOA order of the HOA data, relevant for frontal area, needs to be large to enable holophonic replay at choice. A typical order is N=10. This requires $(N+1)^2=121$ HOA coefficients. In theory we could encode also M=121 audio objects, if this audio objects would be evenly spatially distributed. But in our scenario they are constricted to the frontal area (because only here we need such high orders). In fact we can only code about M=60 Audio objects without blur (the frontal area is at most half a sphere of directions, thus M/2).

Regarding the above-mentioned B-Format, it enables a description only up to an Ambisonics order of 3, and the file size is restricted to 4 GB. Other special information items are missing, like the wave type or the reference decoding radius which are vital for modern decoders. It is not possible to use different sample formats (word widths) and bandwidths for the different Ambisonics components (channels). There is also no standardisation for storing side information and metadata for Ambisonics.

In the known art, recording Ambisonics signals using a microphone array is restricted to orders of one. This might change in the future if experimental prototypes of HOA microphones will be developed. For the creation of 3D content a description of the ambience sound field could be recorded using a microphone array in first order Ambisonics, whereby the directional sources are captured using close-up mono microphones or highly directional microphones together with directional information (i.e. the position of the source). The directional signals can then be encoded into a HOA description, or this might be performed by a sophisticated decoder. Anyhow, a new Ambisonics file format needs to be able to store more than one sound field description at once, but it appears that no existing format can encapsulate more than one Ambisonics description.

A problem to be solved by the invention is to provide an Ambisonics file format that is capable of storing two or more sound field descriptions at once, wherein the Ambisonics order can be greater than 3. This problem is solved by the data structure disclosed in claim 1 and the method disclosed in claim 12.

For recreating realistic 3D Audio, next-generation Ambisonics decoders will require either a lot of conventions and stipulations together with stored data to be processed, or a single file format where all related parameters and data elements can be coherently stored.

The inventive file format for spatial sound content can store one or more HOA signals and/or directional mono signals together with directional information, wherein Ambisonics orders greater than 3 and files >4 GB are feasible. Furthermore, the inventive file format provides additional elements which existing formats do not offer:

1) Vital information required for next-generation HOA decoders is stored within the file format:
   - Ambisonics wave information (plane, spherical, mixture types), region of interest (sources outside the listening area or within), and reference radius (for decoding of spherical waves)
   - Related directional mono signals can be stored. Position information of these directional signals can be described either using angle and distance information or an encoding vector of Ambisonics coefficients.
2) All parameters defining the Ambisonics data are contained within the side information, to ensure clarity about the recording:
   - Ambisonics scaling and normalisation (SN3D, N3D, Furse Malham, B Format, . . . , user defined), mixed order information.
3) The storage format of Ambisonics data is extended to allow for a flexible and economical storage of data:
   - The inventive format allows storing data related to the Ambisonics order (Ambisonics channels) with different PCM-word size resolution as well as using restricted bandwidth.
4) Meta fields allow storing accompanying information about the file like recording information for microphone signals:
   - Recording reference coordinate system, microphone, source and virtual listener positions, microphone directional characteristics, room and source information.

This file format for 2D and 3D audio content covers the storage of both Higher Order Ambisonics descriptions (HOA) as well as single sources with fixed or time-varying positions, and contains all information enabling next-generation audio decoders to provide realistic 3D Audio.

Using appropriate settings, the inventive file format is also suited for streaming of audio content. Thus, content-dependent side info (header data) can be sent at time instances as selected by the creator of the file. The inventive file format serves also as scene description where tracks of an audio scene can start and end at any time.

In principle, the inventive data structure is suited for Higher Order Ambisonics HOA audio data, which data structure includes 2D and/or 3D spatial audio content data for one or more different HOA audio data stream descriptions, and which data structure is also suited for HOA audio data that have on order of greater than '3', and which data structure in addition can include single audio signal source data and/or microphone array audio data from fixed or time-varying spatial positions.

In principle, the inventive method is suited for audio presentation, wherein an HOA audio data stream containing at least two different HOA audio data signals is received and at least a first one of them is used for presentation with a dense loudspeaker arrangement located at a distinct area of a presentation site, and at least a second and different one of them is used for presentation with a less dense loudspeaker arrangement surrounding said presentation site.

Advantageous additional embodiments of the invention are disclosed in the respective dependent claims.

DRAWINGS

Figure 2:
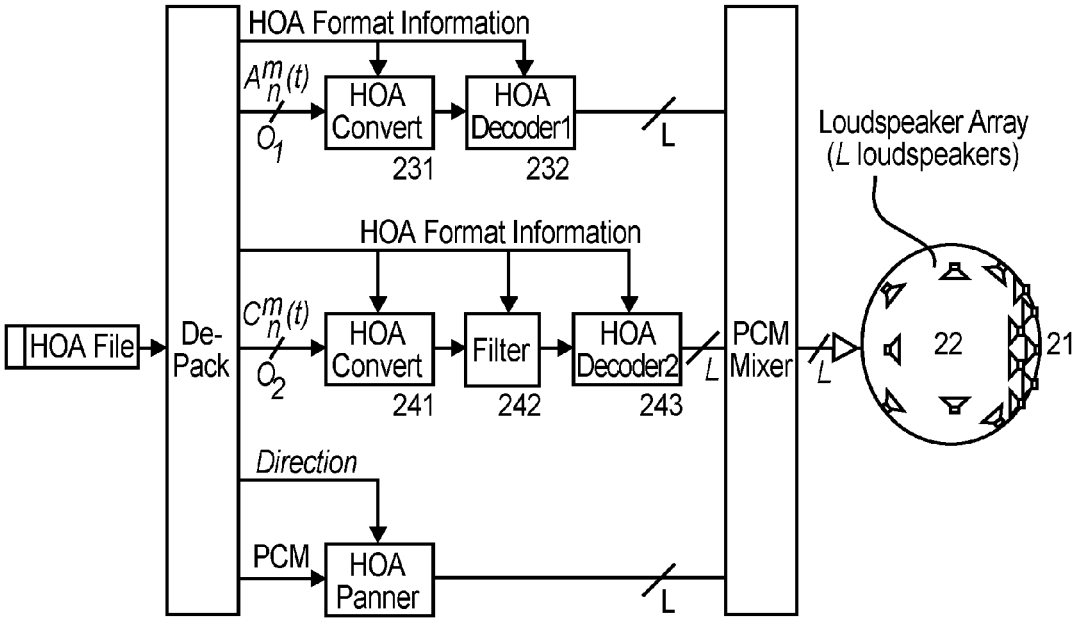
Figure 3:
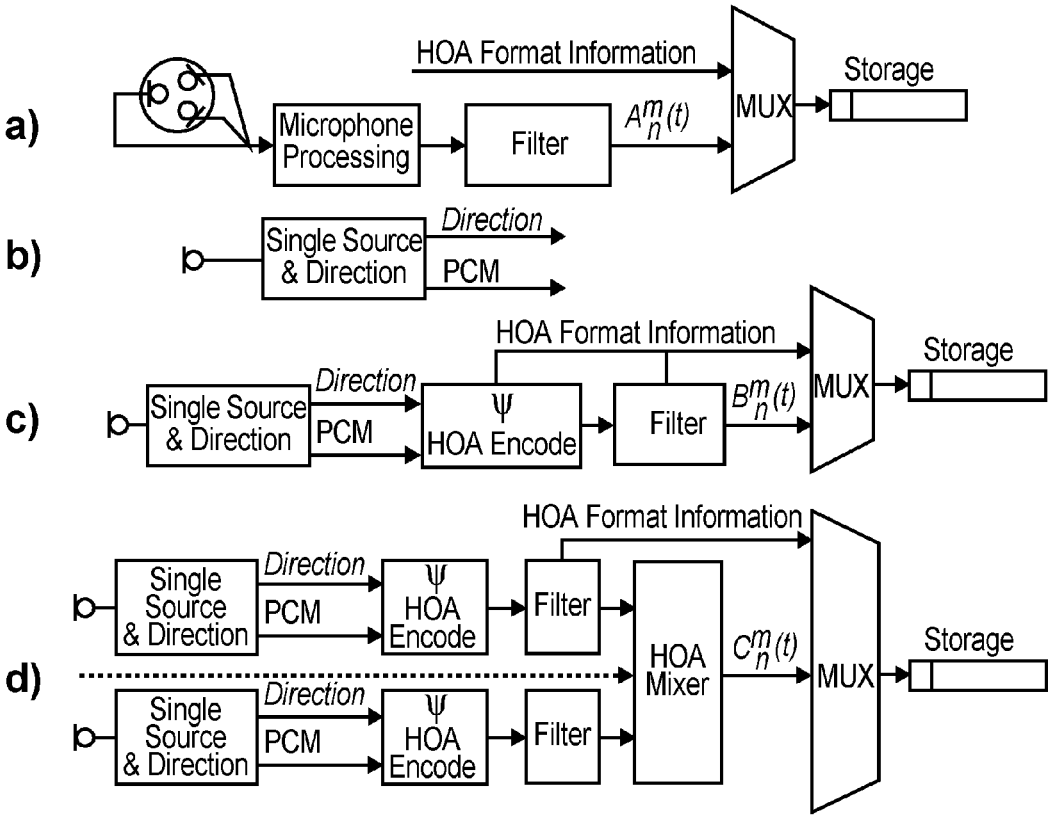
Figure 4:
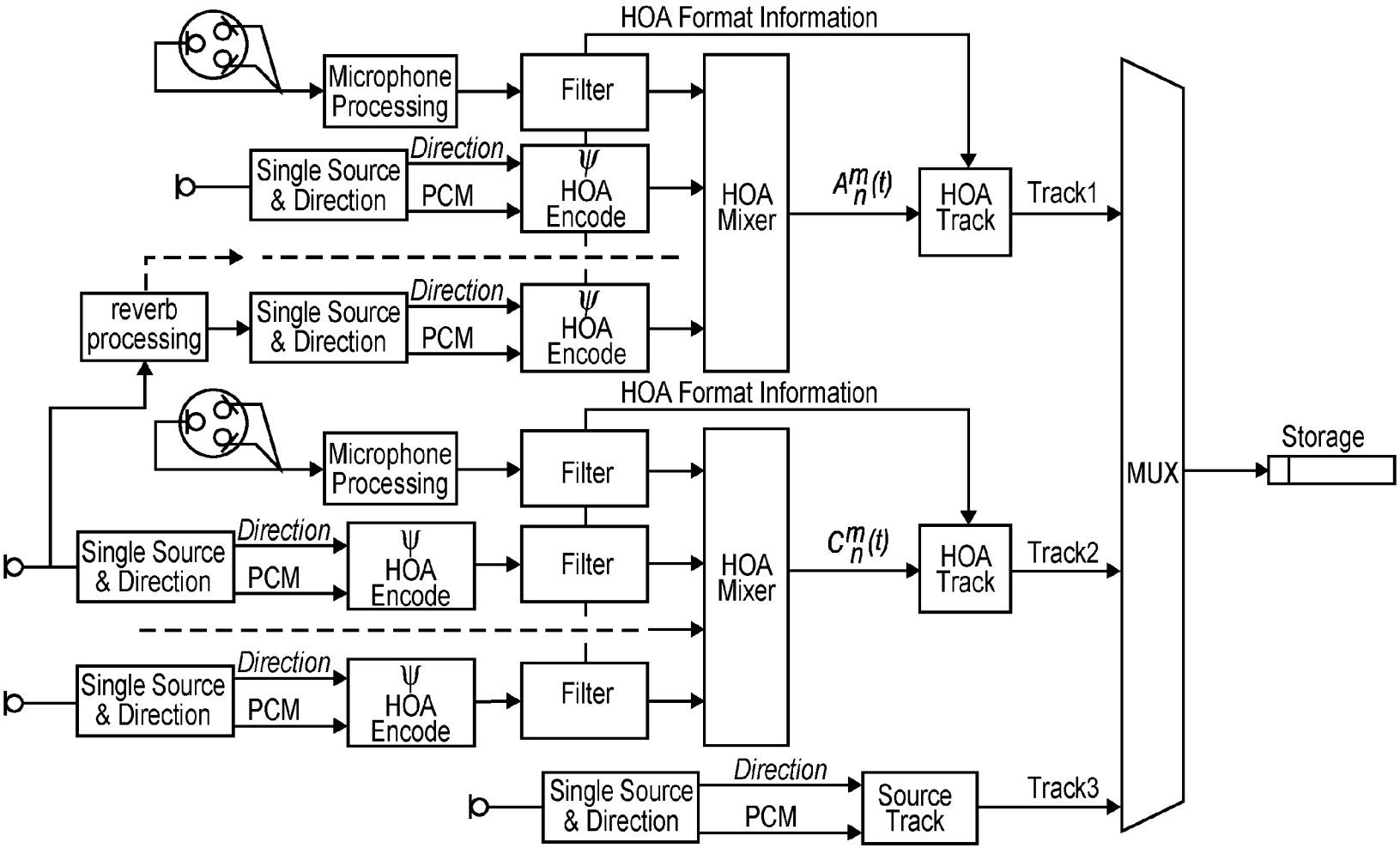
Figure 5:
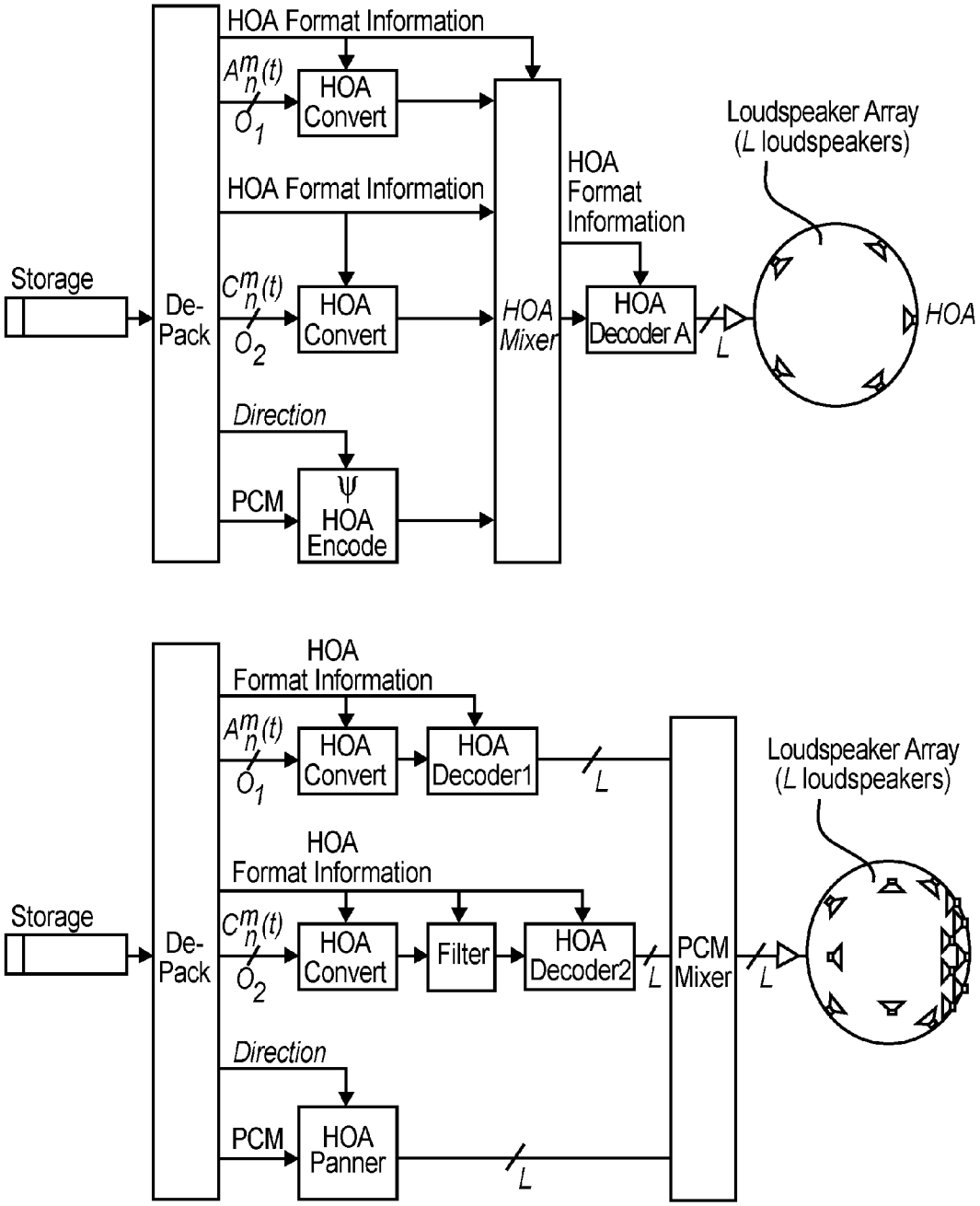
Figure 6:
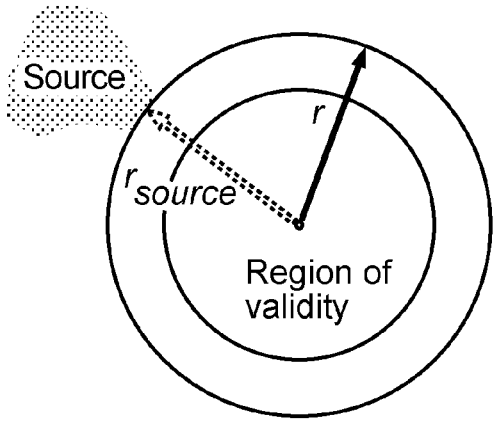
Figure 7:
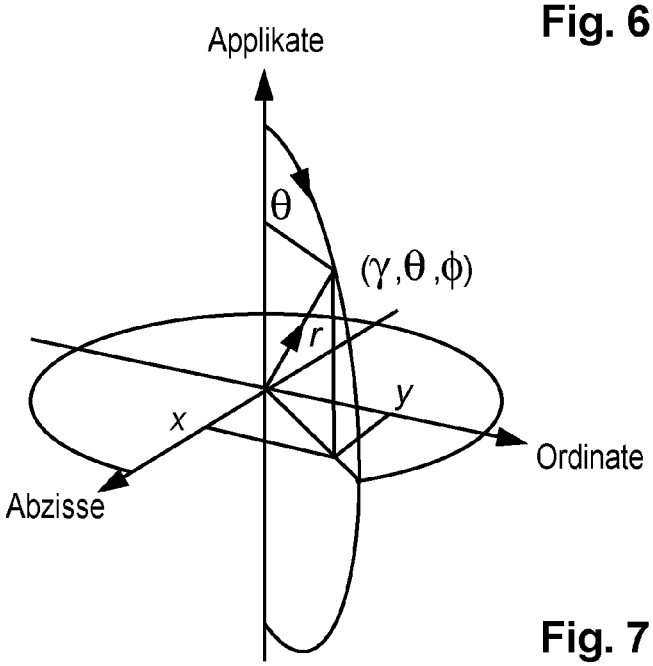
Figure 8:
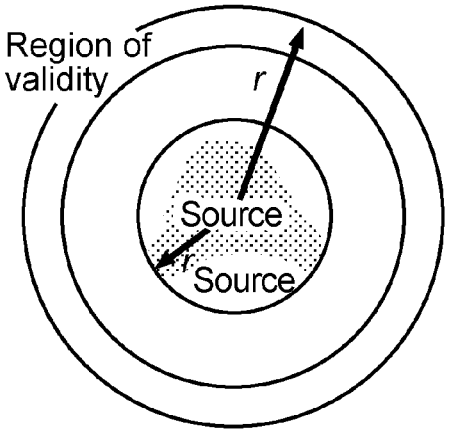
Figure 9:
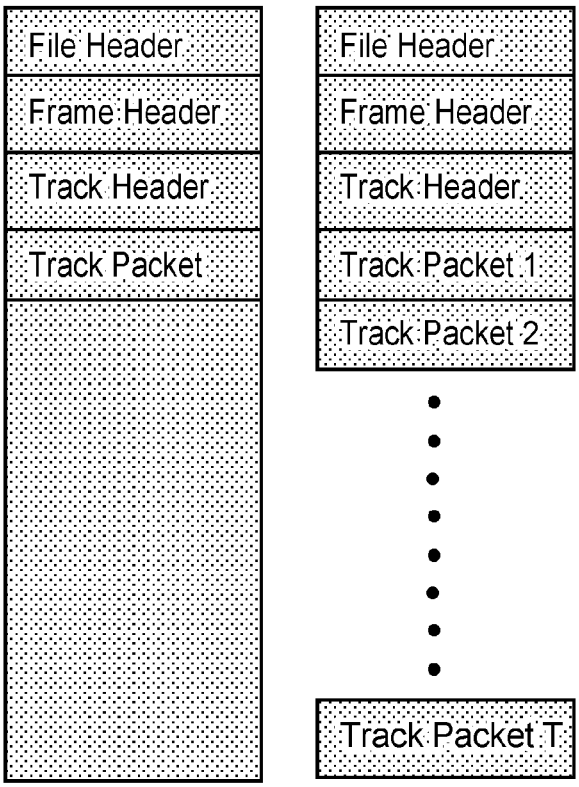
Figure 11:
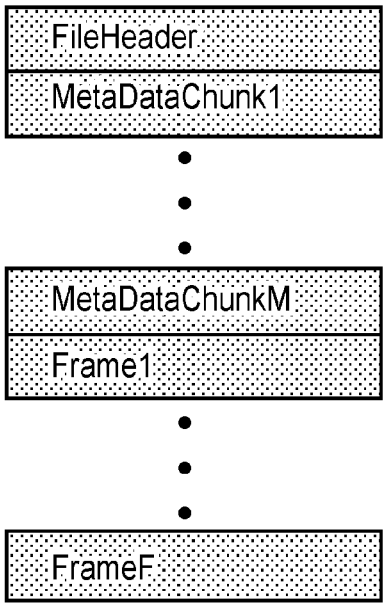
Figure 10:
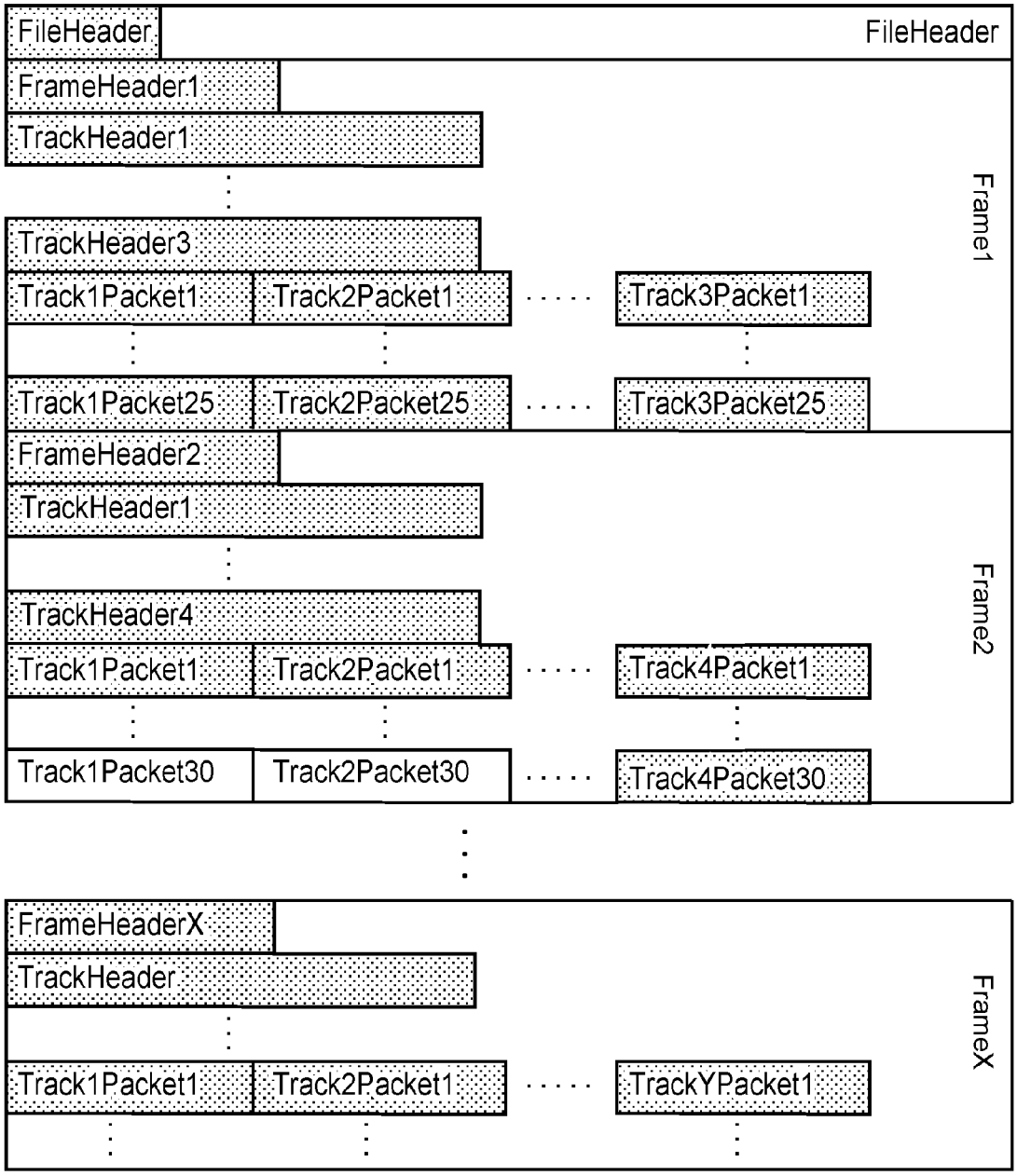
Figure 12:
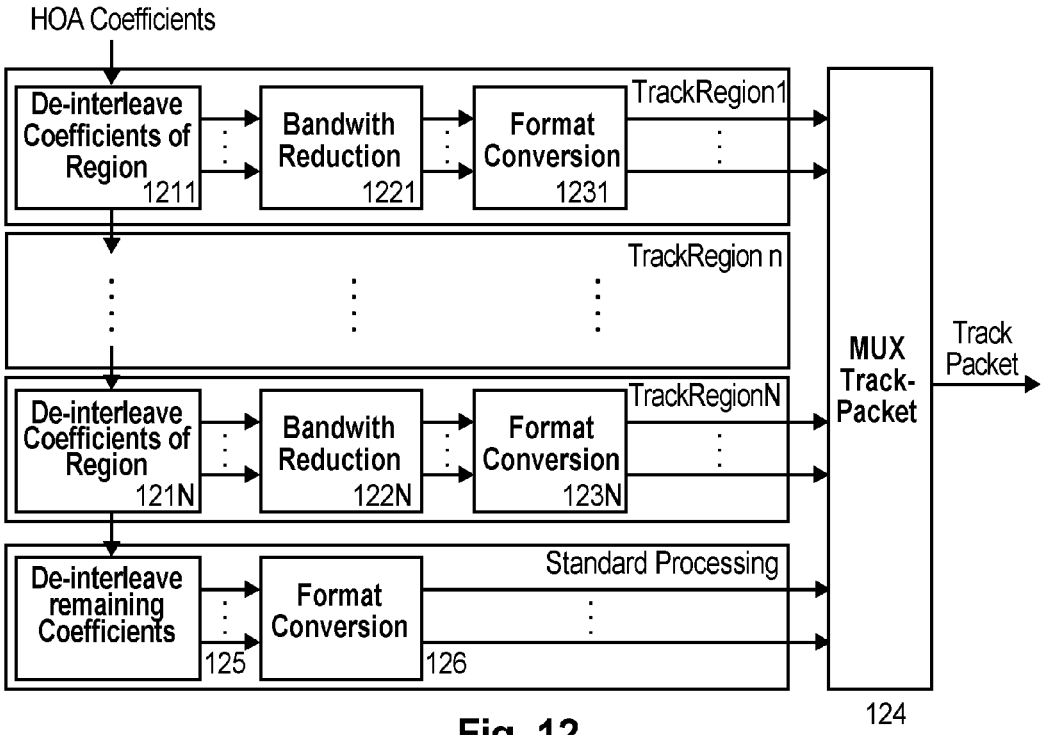
Figure 13:
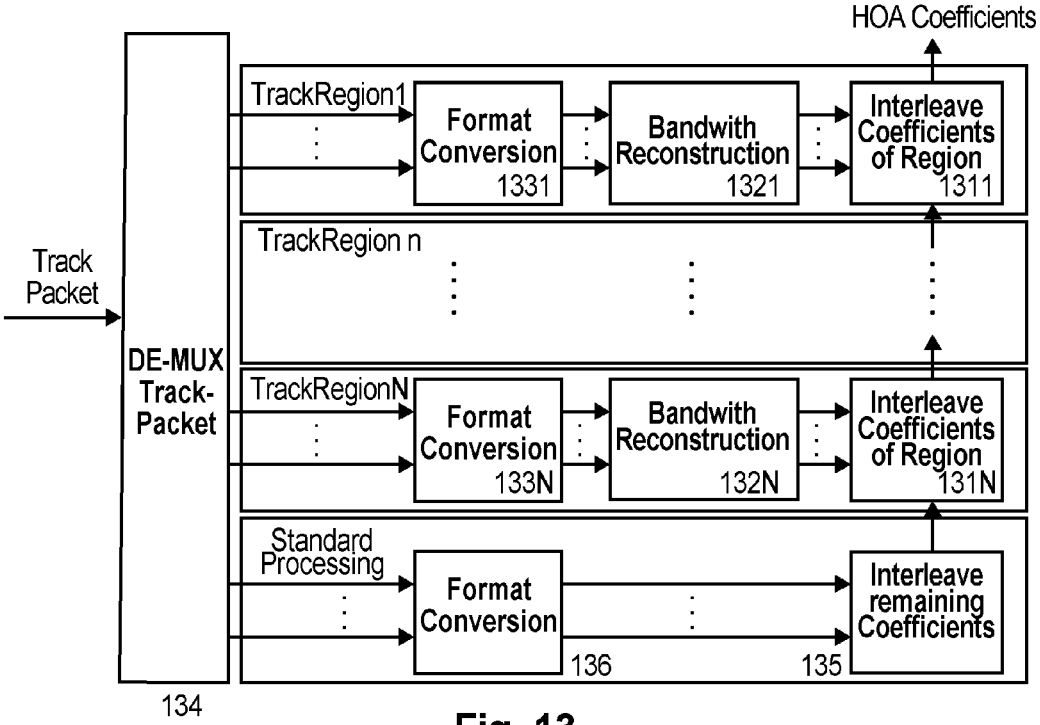
Figure 14:
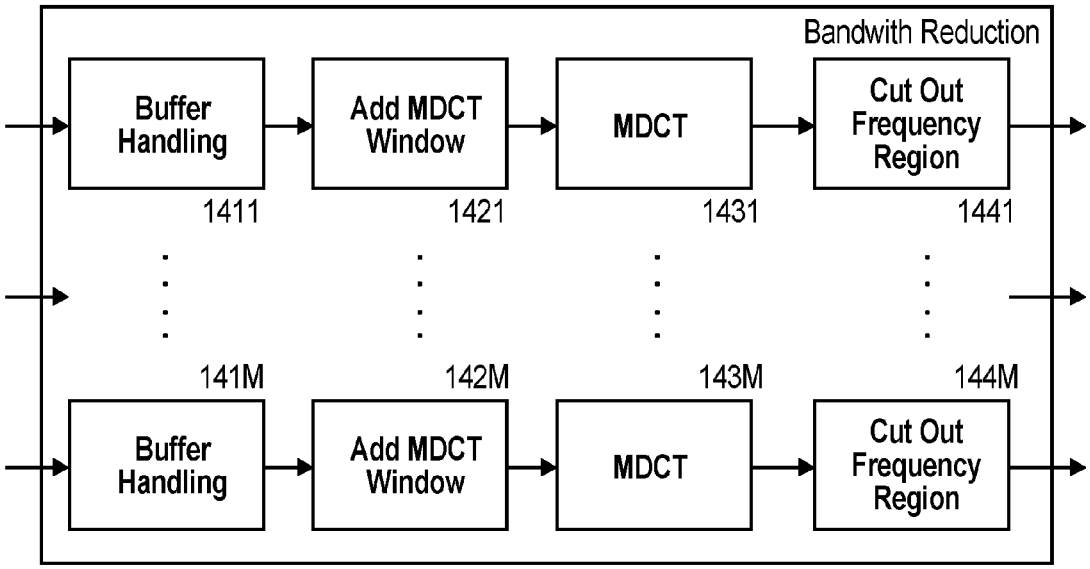
Figure 15:
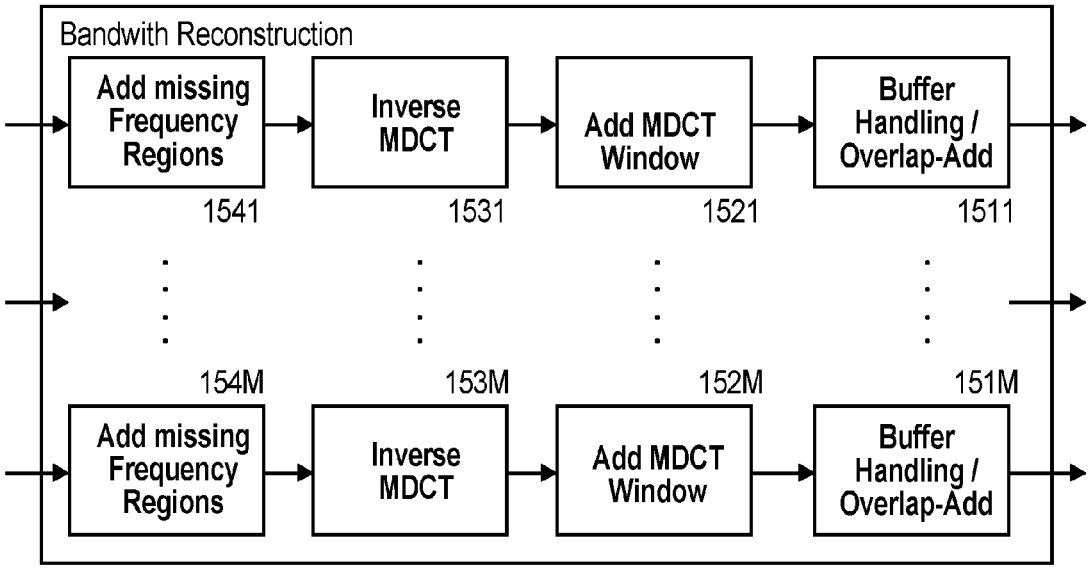

Exemplary embodiments of the invention are described with reference to the accompanying drawings, which show in:

FIG. 1 holophonic reproduction in cinema with dense speaker arrangements at the frontal region and coarse speaker density surrounding the listening area;

FIG. 2 sophisticated decoding system;

FIG. 3 HOA content creation from microphone array recording, single source recording, simple and complex sound field generation;

FIG. 4 next-generation immersive content creation;

FIG. 5 2D decoding of HOA signals for simple surround loudspeaker setup, and 3D decoding of HOA signals for a holophonic loudspeaker setup for frontal stage and a more coarse 3D surround loudspeaker setup;

FIG. 6 interior domain problem, wherein the sources are outside the region of interest/validity;

FIG. 7 definition of spherical coordinates;

FIG. 8 exterior domain problem, wherein the sources are inside the region of interest/validity;

FIG. 9 simple example HOA file format;

FIG. 10 example for a HOA file containing multiple frames with multiple tracks;

FIG. 11 HOA file with multiple MetaDataChunks;

FIG. 12 TrackRegion encoding processing;

FIG. 13 TrackRegion decoding processing;

FIG. 14 Implementation of Bandwidth Reduction using the MDCT processing;

FIG. 15 Implementation of Bandwidth Reconstruction using the MDCT processing.

EXEMPLARY EMBODIMENTS

With the growing spread of 3D video, immersive audio technologies are becoming an interesting feature to differentiate. Higher Order Ambisonics (HOA) is one of these technologies which can provide a way to introduce 3D Audio in an incremental way into cinemas. Using HOA sound tracks and HOA decoders, a cinema can start with existing audio surround speaker setups and invest for more loudspeakers step-by-step, improving the immersive experience with each step.

FIG. 1*a* shows holophonic reproduction in cinema with dense loudspeaker arrangements 11 at the frontal region and coarser loudspeaker density 12 surrounding the listening or seating area 10, providing a way of accurate reproduction of sounds related to the visual action and of sufficient accuracy of reproduced ambient sounds.

FIG. 1*b* shows the perceived direction of arrival of reproduced frontal sound waves, wherein the direction of arrival of plane waves matches different screen positions, i.e. plane waves are suitable to reproduce depth.

FIG. 1*c* shows the perceived direction of arrival of reproduced spherical waves, which lead to better consistency of perceived sound direction and 3D visual action around the screen.

The need for two different HOA streams is caused in the fact that the main visual action in a cinema takes place in the frontal region of the listeners. Also, the perceptive precision of detecting the direction of a sound is higher for frontal sound sources than for surrounding sources. Therefore the precision of frontal spatial sound reproduction needs to be higher than the spatial precision for reproduced ambient sounds. Holophonic means for sound reproduction, a high number of loudspeakers, a dedicated decoder and related speaker drivers are required for the frontal screen region, while less costly technology is needed for ambient sound reproduction (lower density of speakers surrounding the listening area and less perfect decoding technology).

Due to content creation and sound reproduction technologies, it is advantageous to supply one HOA representation for the ambient sounds and one HOA representation for the foreground action sounds, cf. FIG. 4. A cinema using a simple setup with a simple coarse reproduction sound equipment can mix both streams prior to decoding (cf. FIG. 5 upper part).

A more sophisticated cinema equipped with full immersive reproduction means can use two decoders—one for decoding the ambient sounds and one specialised decoder for high-accuracy positioning of virtual sound sources for the foreground main action, as shown in the sophisticated decoding system in FIG. 2 and the bottom part of FIG. 5.

A special HOA file contains at least two tracks which represent HOA sound fields for ambient sounds $A_n^m(t)$ and for frontal sounds related to the visual main action $C_n^m(t)$. Optional streams for directional effects may be provided. Two corresponding decoder systems together with a panner provide signals for a dense frontal 3D holophonic loudspeaker system 21 and a less dense (i.e. coarse) 3D surround system 22. The HOA data signal of the Track 1 stream represents the ambience sounds and is converted in a HOA converter 231 for input to a Decoder1 232 specialised for reproduction of ambience. For the Track 2 data stream, HOA signal data (frontal sounds related to visual scene) is converted in a HOA converter 241 for input to a distance corrected (Eq. (26)) filter 242 for best placement of spherical sound sources around the screen area with a dedicated Decoder2 243. The directional data streams are directly panned to L speakers. The three speaker signals are PCM mixed for joint reproduction with the 3D speaker system.

It appears that there is no known file format dedicated to such scenario. Known 3D sound field recordings use either complete scene descriptions with related sound tracks, or a single sound field description when storing for later reproduction. Examples for the first kind are WFS (Wave Field Synthesis) formats and numerous container formats. The examples for the second kind are Ambisonics formats like the B or AMB formats, cf. the above-mentioned article "File Format for B-Format". The latter restricts to Ambisonics orders of three, a fixed transmission format, a fixed decoder model and single sound fields.

HOA Content Creation and Reproduction

The processing for generating HOA sound field descriptions is depicted in FIG. 3.

In FIG. 3*a*, natural recordings of sound fields are created by using microphone arrays. The capsule signals are matrixed and equalised in order to form HOA signals. Higher-order signals (Ambisonics order >1) are usually band-pass filtered to reduce artefacts due to capsule distance effects: lowpass filtered to reduce spatial alias at high frequencies, and high-pass filtered to reduce excessive low frequency levels with increasing Ambisonics order n ($h_n(kr_{d_mic})$, see Eq. (34). Optionally distance coding filtering may be applied, see Eqs. (25) and (27). Before storage, HOA format information is added to the track header.

Artistic sound field representations are usually created using multiple directional single source streams. As shown in FIG. 3*b*, a single source signal can be captured as a PCM recording. This can be done by close-up microphones or by using microphones with high directivity. In addition the directional parameters ($r_S,\Theta_S,\phi_S$) of the sound source relative to a virtual best listening position are recorded (HOA coordinate system, or any reference point for later mapping). The distance information may also be created by artistically placing sounds when rendering scenes for movies. As shown in FIG. 3*c*, the directional information ($\Theta_S,\phi_S$) is then used to create the encoding vector $\Psi$, and the directional source signal is encoded into an Ambisonics signal, see Eq. (18). This is equivalent to a plane wave representation. A tailing filtering process may use the distance information $r_s$ to imprint a spherical source characteristic into the Ambisonics signal (Eq. (19)), or to apply distance coding filtering, Eqs. (25), (27). Before storage, the HOA format information is added to the track header.

More complex wave field descriptions are generated by HOA mixing Ambisonics signals as depicted in FIG. 3*d*. Before storage, the HOA format information is added to the track header.

The process of content generation for 3D cinema is depicted in FIG. 4. Frontal sounds related to the visual action are encoded with high spatial accuracy and mixed to a HOA signal (wave field) $C_n^m(t)$ and stored as Track 2. The involved encoders encode with a high spatial precision and special wave types necessary for best matching the visual scene. Track 1 contains the sound field $A_n^m(t)$ which is related to encoded ambient sounds with no restriction of source direction. Usually the spatial precision of the ambient sounds needs not be as high as for the frontal sounds (consequently the Ambisonics order can be smaller) and the modelling of wave type is less critical. The ambient sound field can also include reverberant parts of the frontal sound signals. Both tracks are multiplexed for storage and/or exchange.

Optionally, directional sounds (e.g. Track 3) can be multiplexed to the file. These sounds can be special effects sounds, dialogs or sportive information like a narrative speech for visually impaired.

FIG. 5 shows the principles of decoding. As depicted in the upper part, a cinema with coarse loudspeaker setup can mix both HOA signals from Track1 and Track2 before simplified HOA decoding, and may truncate the order of Track2 and reduce the dimension of both tracks to 2D. In case a directional stream is present, it is encoded to 2D HOA. Then, all three streams are mixed to form a single HOA representation which is then decoded and reproduced.

The bottom part corresponds to FIG. 2. A cinema equipped with a holophonic system for the frontal stage and a coarser 3D surround system will use dedicated sophisticated decoders and mix the speakers feeds. For Track 1 data stream, HOA data representing the ambience sounds is converted to Decoder1 specialised for reproduction of ambience. For Track 2 data stream, HOA (frontal sounds related to visual scene) is converted and distance corrected (Eq. (26)) for best placement of spherical sound sources around the screen area with a dedicated Decoder2. The directional data streams are directly panned to L speakers. The three speaker signals are PCM mixed for joint reproduction with the 3D speaker system.

Sound Field Descriptions Using Higher Order Ambisonics

Sound Field Description Using Spherical Harmonics (SH)

When using spherical Harmonic/Bessel descriptions, the solution of the acoustic wave equation is provided in Eq. (1), cf. M. A. Poletti, "Three-dimensional surround sound systems based on spherical harmonics", Journal of Audio Engineering Society, 53(11), pp. 1004-1025, November 2005, and Earl G. Williams, "Fourier Acoustics", Academic Press, 1999. The sound pressure is a function of spherical coordinates r,Θ,ϕ (see FIG. 7 for their definition) and spatial frequency $$k = \frac{\omega}{c} = \frac{2\pi f}{c}.$$

The description is valid for audio sound sources outside the region of interest or validity (interior domain problem, as shown in FIG. 6) and assumes orthogonal-normalised Spherical Harmonics:

$$p(r,\theta,\phi,k)=\Sigma_{n=0}^{\infty}\Sigma_{m=-n}^{n}A_n^m(k)j_n(kr)Y_n^m(\theta,\phi) \quad (1)$$

The $A_n^m(k)$ are called Ambisonic Coefficients, $j_n(kr)$ is the spherical Bessel function of first kind, $Y_n^m(\theta,\phi)$ are called Spherical Harmonics (SH), n is the Ambisonics order index, and m indicates the degree.

Due to the nature of the Bessel function which has significant values for small kr values only (small distances from origin or low frequencies), the series can be stopped at some order n and restricted to a value N with sufficient accuracy. When storing HOA data, usually the Ambisonics coefficients $A_n^m$,$B_n^m$ or some derivates (details are described below) are stored up to that order N. N is called the Ambisonics order.

N is called the Ambisonics order, and the term 'order' is usually also used in combination with the n in Bessel $j_n(kr)$ and Hankel $h_n(kr)$ functions.

The solution of the wave equations for the exterior case, where the sources lie within a region of interest or validity as depicted in FIG. 8, is expressed for $r>r_{Source}$ in Eq (2).

$$p(r,\theta,\phi,k)=\Sigma_{n=0}^{\infty}\Sigma_{m=-n}^{n}B_n^m(k)h_n^{(1)}(kr)Y_n^m(\theta,\phi) \quad (2)$$

The $B_n^m(k)$ are again called Ambisonics coefficients and $h_n^{(1)}(kr)$ denotes the spherical Hankel function of first kind and $n^{th}$ order. The formula assumes orthogonal-normalised SH.

Remark: Generally the spherical Hankel function of first kind $h_n^{(1)}$ is used for describing outgoing waves (related to $e^{ikr}$) for positive frequencies and the spherical Hankel function of second kind $h_n^{(2)}$ is used for incoming waves (related to $e^{-ikr}$), cf. the above-mentioned "Fourier Acoustics" book.

Spherical Harmonics

The spherical harmonics $Y_n^m$ may be either complex or real valued. The general case for HOA uses real valued spherical harmonics. A unified description of Ambisonics using real and complex spherical harmonics may be reviewed in Mark Poletti, "Unified description of Ambisonics using real and complex spherical harmonics", Proceedings of the Ambisonics Symposium 2009, Gras, Austria, June 2009.

There are different ways to normalise the spherical harmonics (which is independent from the spherical harmonics being real or complex), cf. the following web pages regarding (real) spherical harmonics, and normalisation schemes: http://www.ipqp.fr/~wiecsor/SHTOOLS/www/conventions.html, http://en.citisendium.org/wiki/Spherical_Harmonics. The normalisation corresponds to the orthogonally relationship between $Y_n^m$ and $Y_{n'}^{m'*}$ Remark:

$$\int_{S^2} Y_n^m(\Omega) Y_{n'}^{m'}(\Omega)^* \, d\Omega = \frac{N_{n,m}}{\sqrt{\frac{(2n+1)(n-|m|)!}{4\pi(n+|m|)!}}} \frac{N_{n',m'}}{\sqrt{\frac{(2n'+1)(n'-|m'|)!}{4\pi(n'+|m'|)!}}} \delta_{nn'} \delta_{mm'}$$

wherein $S^2$ is the unit sphere and Kroneker delta $\delta_{aa'}$ equals 1 for a=a', 0 else.

Complex spherical harmonics are described by:

$$Y_n^m(\Theta,\phi) = s_m \Theta_n^m(\theta) e^{im\phi} = s_m N_{n,m} P_{n,|m|}(\cos(\theta)) e^{im\phi} \tag{3}$$

wherein $i=\sqrt{-1}$ and $$s_m = \begin{cases} (-1)^m & m > 0 \\ 1 & \text{else} \end{cases}$$

for an alternating sign for positive m like in the above-mentioned "Fourier Acoustics" book. (Remark: the $s_m$ is a term of convention and may be omitted for positive-only SH). $N_{n,m}$ is a normalisation term which takes form for an orthogonal-normalised representation (! denotes factorial):

$$N_{n,m} = \sqrt{\frac{(2n+1)(n-|m|)!}{4\pi(n+|m|)!}} \tag{4}$$

Below Table 1 shows some commonly used normalisation schemes for the complex valued spherical harmonics. $P_{n,|m|}(x)$ are the associated Legendre functions, wherein it is followed the notation with from the above article "Unified description of Ambisonics using real and complex spherical harmonics" which avoids the phase term $(-1)^m$ called the Condon-Shortley phase, and which sometimes is included within the representation of $P_n^m$ within other notations. The associated Legendre functions $P_{n,|m|}:[-1,1]\rightarrow\mathbb{R}$, $n \geq |m| \geq 0$ can be expressed using the Rodrigues formula as:

$$P_{n,|m|}(x) = \frac{1}{2^n n!}(1-x^2)^{\frac{|m|}{2}} \frac{d^{n+|m|}}{dx^{n+|m|}}(x^2-1)^n \tag{5}$$

TABLE 1

Normalisation factors for complex-valued spherical harmonics $N_{n,m}$, Common normalisation schemes for complex SH

| Not normalised | Schmidt semi-normalised, SN3D | 4π normalised, N3D, geodesy 4 π | Ortho-normalised |
|---|---|---|---|
| 1 | $\sqrt{\frac{(n-\lvert m\rvert)!}{(n+\lvert m\rvert)!}}$ | $\sqrt{\frac{(2n+1)(n-\lvert m\rvert)!}{(n+\lvert m\rvert)!}}$ | $\sqrt{\frac{(2n+1)(n-\lvert m\rvert)!}{4\pi\ (n+\lvert m\rvert)!}}$ |

Numerically it is advantageous to derive $P_{n,|m|}(x)$ in a progressive manner from a recurrence relationship, see William H. Press, Saul A. Teukolsky, William T. Vetterling, Brian P. Flannery, "Numerical Recipes in C", Cambridge University Press, 1992. The associated Legendre functions up to n=4 are given in Table 2:

TABLE 2

The first few Legendre Polynomials $P_{n,|m|}(\cos\theta)$, n = 0 . . . 4

| | n | | | | |
|---|---|---|---|---|---|
| m | 0 | 1 | 2 | 3 | 4 |
| 0 | $P_0^0(\cos\theta) = 1$ | $P_1^0(\cos\theta) = \cos\theta$ | $P_2^0(\cos\theta) = \frac{1}{2}(3\cos^2\theta - 1)$ | $P_3^0(\cos\theta) = \frac{1}{2}(5\cos^3\theta - 3\cos\theta)$ | $P_4^0(\cos\theta) = \frac{1}{8}(35\cos^4\theta - 30\cos\theta^2 + 3)$ |
| 1 | | $P_1^1(\cos\theta) = \sin\theta$ | $P_2^1(\cos\theta) = 3\cos\theta\sin\theta$ | $P_3^1(\cos\theta) = \frac{3}{2}(5\cos^2\theta - 1)\sin\theta$ | $P_4^1(\cos\theta) = \frac{5}{2}(7\cos^3\theta - 3\cos\theta)\sin\theta$ |
| 2 | | | $P_2^2(\cos\theta) = 3\sin^2\theta$ | $P_3^2(\cos\theta) = 15\cos\theta\sin^2\theta$ | $P_4^2(\cos\theta) = \frac{15}{2}(7\cos^2\theta - 1)\sin^2\theta$ |
| 3 | | | | $P_3^3(\cos\theta) = 15\sin^3\theta$ | $P_4^3(\cos\theta) = 105\cos\theta\sin^3\theta$ |
| 4 | | | | | $P_4^4(\cos\theta) = 105\sin^4\theta$ |

Real valued SH are derived by combining complex conjugate $Y_n^m$ corresponding to opposite values of m (the term $(-1)^m$ in the definition (6) is introduced to obtain unsigned expressions for the real SH, which is the usual case in Ambisonics):

$$S_n^m(\theta,\phi)=\begin{cases}\frac{(-1)^m}{\sqrt{2}}(Y_n^m+Y_n^{m*})=\Theta_n^m(\theta)\sqrt{2}\cos(m\phi), & m>0\\ Y_n^0=\Theta_n^0(\theta), & m=0\\ \frac{(-1)^m}{i\sqrt{2}}(Y_n^{|m|}-Y_n^{|m|*})=\Theta_n^{|m|}(\theta)\sqrt{2}\sin(|m|\phi), & m<0\end{cases} \tag{6}$$

which can be rewritten as Eq. (7) for highlighting the connection to circular harmonics with $\phi_m(\phi)=\phi_{n=|m|}{}^m(\phi)$ just holding the azimuth term:

$$S_n^m(\theta,\phi)=\tilde{N}_{n,m}P_{n,|m|}(\cos(\theta))\Phi_m(\phi) \tag{7}$$

$$\Phi_{n=|m|}^m(\phi)=\begin{cases}\cos(m\phi), & m>0\\ 1 & m=0\\ \sin(|m|\phi) & m<0\end{cases} \tag{8}$$

The total number of spherical components $S_n^m$ for a given Ambisonics order N equals $(N+1)^2$. Common normalisation schemes of the real valued spherical harmonics are given in Table 3.

TABLE 3

3D real SH normalisation schemes, $\delta_{0,m}$ has a value of 1 for m = 0 and 0 else $\tilde{N}_{n,m}$, Common normalisation schemes for real SH

| Not normalised | Schmidt semi-normalised, SN3D | 4π normalised, N3D, geodesy 4 π | Ortho-normalised |
|---|---|---|---|
| $\sqrt{2-\delta_{0,m}}$ | $\sqrt{(2-\delta_{0,m})\frac{(n-\lvert m\rvert)!}{(n+\lvert m\rvert)!}}$ | $\sqrt{(2-\delta_{0,m})\frac{(2n+1)(n-\lvert m\rvert)!}{(n+\lvert m\rvert)!}}$ | $\sqrt{(2-\delta_{0,m})\frac{(2n+1)(n-\lvert m\rvert)!}{4\pi\ (n+\lvert m\rvert)!}}$ |

Circular Harmonics

For two-dimensional representations only a subset of harmonics is needed. The SH degree can only take values $m\in\{-n,n\}$. The total number of components for a given N reduces to 2N+1 because components representing the inclination θ become obsolete and the spherical harmonics can be replaced by the circular harmonics given in Eq. (8).

There are different normalisation $N_m$ schemes for circular harmonics, which need to be considered when converting 3D Ambisonics coefficients to 2D coefficients. The more general formula for circular harmonics becomes:

$$\bar{\Phi}_{n=|m|}^m(\phi)=N_m\Phi_m(\phi)=\begin{cases}N_m\cos(m\phi), & m>0\\ N_m & m=0\\ N_m\sin(|m|\phi) & m<0\end{cases} \tag{9}$$

Some common normalisation factors for the circular harmonics are provided in Table 4, wherein the normalisation term is introduced by the factor before the horizontal term $\phi_m(\phi)$:

TABLE 4

2D CH normalisation schemes, $\delta_{0,m}$ has a value of 1 for m = 0 and 0 else $N_m$, Common normalisation schemes for Circular Harmonics

| Not normalised | SN2D | 2D normalised, N2D | Ortho-normalised |
|---|---|---|---|
| $\sqrt{\frac{2-\delta_{0,m}}{2}}$ | 1 | $\sqrt{(2-\delta_{0,m})}$ | $\sqrt{(2-\delta_{0,m})\frac{1}{2\pi}}$ |

Conversion between different normalisations is straightforward. In general, the normalisation has an effect on the notation describing the pressure (cf. Eqs. (1),(2)) and all derived considerations. The kind of normalisation also influences the Ambisonics coefficients. There are also weights that can be applied for scaling these coefficients, e.g. Furse-Malham (FuMa) weights applied to Ambisonics coefficients when storing a file using the AMB-format.

Regarding 2D-3D conversion, CH to SH conversion and vice versa can also be applied to Ambisonics coefficients, for example when decoding a 3D Ambisonics representation (recording) with a 2D decoder for a 2D loudspeaker setting. The relationship between $S_n^m$ and $\check{\phi}_{n=|m|}{}^m$ for 3D-2D conversion is depicted in the following scheme up to an Ambisonics order of 4:

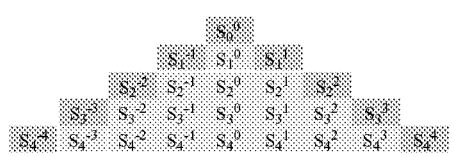

The conversion factor 2D to 3D can be derived for the horizontal pane at $$\theta=\frac{\pi}{2}$$

as follows:

$$\alpha_{\frac{2D}{3D}}=\frac{s_{n=m}^m(\theta=\pi/2,\Phi)}{\bar{\Phi}_{n=|m|}^m(\phi)}=\frac{\tilde{N}_{m,m}}{N_m}\frac{(2m)!}{m!2^m} \tag{10}$$

Conversion from 3D to 2D uses $$1/\alpha_{\frac{2D}{3D}}.$$

Details are presented in connection with Eqs. (28)(29)(30) below.

A conversion 2D normalised to orthogonal-normalised becomes:

$$\alpha_{\frac{N2D}{ortho3D}} = \sqrt{\frac{(2m+1)!}{4\pi m!^2 2^{2m}}} \tag{11}$$

Ambisonics Coefficients

The Ambisonics coefficients have the unit scale of the sound pressure:

$$1\text{Pa} = 1\frac{N}{m^2} = 1\frac{\text{kg m}}{s^2 m^2}.$$

The Ambisonics coefficients form the Ambisonics signal and in general are a function of discrete time. Table 5 shows the relationship between dimensional representation, Ambisonics order N and number of Ambisonics coefficients (channels):

TABLE 5

| Number of Ambisonics coefficients | | | | |
|---|---|---|---|---|
| | Number of Ambisonics Coefficients<br>Number of Ambisonics Channels | | | |
| Dimension | N = 1 | N = 2 | N = 3 | N |
| 2D | 3 | 5 | 7 | 2 N + 1 |
| 3D | 4 | 9 | 16 | $(N+1)^2$ |

When dealing with discrete time representations usually the Ambisonics coefficients are stored in an interleaved manner like PCM channel representations for multichannel recordings (channel=Ambisonics coefficient $A_n^m$ of sample v), the coefficient sequence being a matter of convention. An example for 3D, N=2 is:

$$A_0^0(v)A_1^{-1}(v)A_1^0(v)A_1^1(v)A_2^{-2}(v)A_2^{-1}(v)A_2^0(v)A_2^1(v)\ A_2^2(v)A_0^0(v+1) \tag{12}$$

and for 2D,N=2:

$$A_0^0(v)A_1^{-1}(v)A_1^1(v)A_2^{-2}(v)A_2^2(v)A_0^0(v+1)A_1^{-1}(v+1) \tag{13}$$

The $A_0^0(n)$ signal can be regarded as a mono representation of the Ambisonics recording, having no directional information but being a representative for the general timbre impression of the recording.

The normalisation of the Ambisonics coefficients is generally performed according to the normalisation of the SH (as will become apparent below, see Eq. (15)), which must be taken into account when decoding an external recording ($A_n^m$ are based on SH with normalisation factor $N_{n,m}$, $\check{A}_n^m$ are based on SH with normalisation factor $\check{N}_{n,m}$):

$$A_n^m = \frac{N_{n,m}}{\check{N}_{n,m}}\check{A}_n^m, \tag{14}$$

which becomes $A_{N3D_n}^m = \sqrt{(2n+1)}\check{A}_{SN3D_n}^m$ for the SN3D to N3D case.

The B-Format and the AMB format use additional weights (Gerson, Furse-Malham (FuMa), MaxN weights) which are applied to the coefficients. The reference normalisation then usually is SN3D, cf. Jérôme Daniel, "Représentation de champs acoustiques, application à la transmission et à la reproduction de scènes sonores complexes dans un contexte multimédia", PhD thesis, Université Paris 6, 2001, and Dave Malham, "3-D acoustic space and its simulation using ambisonics", http://www.dxarts.washington.edu/courses/567/current/malham_3d.pdf.

The following two specific realisations of the wave equations for ideal plane waves or spherical waves present more details about the Ambisonics coefficients:

Plane Waves

Solving the wave equation for plane waves $A_n^m$ becomes independent of k and $r_s$; $\theta_s,\phi_s$ describe the source angles, '*' denotes conjugate complex:

$$A_{n_{plane}}^m(\theta_s,\phi_s) = 4\pi i^n P_{S_0} Y_n^m(\theta_s,\phi_s)^* = 4\pi i^n d_n^m(\theta_s,\phi_s) \tag{15}$$

Here $P_{S_0}$ is used to describe the scaling signal pressure of the source measured at the origin of the describing coordinate system which can be a function of time and becomes $A_{0_{plane}}^0/\sqrt{4\pi}$ for orthogonal-normalised spherical harmonics. Generally, Ambisonics assumes plane waves and Ambisonics coefficients $$d_n^m(\theta_s,\phi_s) = \frac{A_n^m(\theta_s,\phi_s)}{4\pi i^n} = P_{S_0} Y_n^m(\theta_s,\phi_s)^* \tag{16}$$

are transmitted or stored. This assumption offers the possibility of superposition of different directional signals as well as a simple decoder design. This is also true for signals of a Soundfield™ microphone recorded in first-order B-format (N=1), which becomes obvious when comparing the phase progression of the equalising filters (for theoretical progression, see the above-mentioned article "Unified description of Ambisonics using real and complex spherical harmonics", chapter 2.1, and for a patent-protected progression see U.S. Pat. No. 4,042,779. Eq. (1) becomes:

$$p(r,\theta,\phi,k) = \Sigma_{n=0}^{\infty}\Sigma_{m=-n}^{n} j_n(kr) Y_n^m(\theta,\phi) 4\pi i^n P_{S_0} Y_n^m(\theta_s,\phi_s)^* \tag{17}$$

The coefficients $d_n^m$ can either be derived by post-processed microphone array signals or can be created synthetically using a mono signal $P_{S_0}(t)$ in which case the directional spherical harmonics $Y_n^m(\theta_s,\phi_s,t)^*$ can be time-dependent as well (moving source). Eq. (17) is valid for each temporal sampling instance v. The process of synthetic encoding can be rewritten (for every sample instance v) in vector/matrix form for a selected Ambisonics order N:

$$d = \Psi P_{S_0} \tag{18}$$

wherein d is an Ambisonics signal, holding $d_n^m(\theta_s,\phi_s)$, (example for N=2: $d(t)=[d_0^0, d_1^{-1}, d_1^0, d_1^1, d_2^{-2}, d_2^{-1}, d_2^0, d_2^1, d_2^2]'$), size $(d)=(N+1)^2\times 1=O\times 1$, $P_{S_0}$ is the source signal pressure at reference origin, and $\Psi$ is the encoding vector, holding $Y_n^m(\theta_S,\phi_S)^*$, $\text{sise}(\Psi)=O\times 1$. The encoding vector can be derived from the spherical harmonics for the specific source direction $\Theta_S,\phi_S$ (equal to the direction of the plane wave).

Spherical Waves

Ambisonics coefficients describing incoming spherical waves generated by point sources (near field sources) for $r<r_s$ are:

$$A^m_{n_{sperical}}(k, \theta_s, \phi_s, r_s) = 4\pi \frac{h_n^{(2)}(kr_s)}{h_0^{(2)}(kr_s)} P_{S_0} Y_n^m(\theta_s, \phi_s)^* \tag{19}$$

This equation is derived in connection with Eqs. (31) to (36) below. $P_{S_0}=p(0|r_s)$ describes the sound pressure in the origin and again becomes identical to $A_0^0/\sqrt{4\pi}$, $h_n^{(2)}$ is the spherical Hankel function of second kind and order n, and $h_0^{(2)}$ is the zeroth-order spherical Hankel function of second kind. Eq. (19) is similar to the teaching in Jérôme Daniel, "Spatial sound encoding including near field effect: Introducing distance coding filters and a viable, new ambisonic format", AES 23rd International Conference, Denmark, May 2003. Here $$\frac{h_n(kr_s)}{h_0(kr_s)} = i^n \sum_{a=0}^{n} \frac{(n+a)!}{(n-a)!a!}\left(-\frac{ic}{2r_s\omega}\right)^a, \; btw \frac{h_1(kr_s)}{h_0(kr_s)} = i\left(1-\frac{ic}{r_s\omega}\right)$$

which, having Eq. (11) in mind, can be found in M. A. Gerson, "General metatheory of auditory localisation", 92th AES Convention, 1992, Preprint 3306, where Gerson describes the proximity effect for first-degree signals.

Synthetic creation of spherical Ambisonics signals is less common for higher Ambisonics orders N because the frequency responses of $$\frac{h_n(kr_s)}{h_0(kr_s)}$$

are hard to numerically handle for low frequencies. These numeric problems can be overcome by considering a spherical model for decoding/reproduction as described below.

Sound Field Reproduction

Plane Wave Decoding

In general, Ambisonics assumes a reproduction of the sound field by L loudspeakers which are uniformly distributed on a circle or on a sphere. When assuming that the loudspeakers are placed far enough from the listener position, a planewave decoding model is valid at the centre ($r_s>\lambda$). The sound pressure generated by L loudspeakers is described by:

$$p(r,\theta,\phi,k)=\Sigma_{n=0}^{\infty}\Sigma_{m=-n}^{n} i^n j_n(kr) Y_n^m(\theta,\phi) 4\pi i^n \Sigma_{l=1}^{L} w_l Y_n^m(\theta_l,\phi_l)^* \tag{20}$$

with $w_l$ being the signal for loudspeaker l and having the unit scale of a sound pressure, 1 Pa. $w_l$ is often called driving function of loudspeaker l.

It is desirable that this Eq. (20) sound pressure is identical to the pressure described by Eq. (17). This leads to:

$$\sum_{l=1}^{L} w_l Y_n^m(\theta_l, \phi_l)^* = d_n^m(\theta_s, \phi_s) = \frac{A_n^m(\theta_s, \phi_s)}{4\pi i^n} \tag{21}$$

This can be rewritten in matrix form, known as 're-encoding formula' (compare to Eq. (18)):

$$d=\Psi y \tag{22}$$

wherein d is an Ambisonics signal, holding $d_n^m(\theta_s,\phi_s)$ or $$\frac{A_n^m(\theta_s, \phi_s)}{4\pi i^n},$$

(example for N=2: $d(n)=[d_0^0,d_1^{-1},d_1^0,d_1^1,d_2^{-2},d_2^{-1},d_2^0,d_2^1,d_2^2,]'$), $size(d)=(N+1)^2\times 1=O\times 1$, $\Psi$ is the (re-encoding) matrix, holding $Y_n^m(\theta_l,\phi_l)^*$, $sise(\Psi)=O\times L$, and y are the loudspeaker signals $w_l$, $sise(y(n),1)=L$.

y can then be derived using a couple of known methods, e.g. mode matching, or by methods which optimise for special speaker panning functions.

Decoding for the Spherical Wave Model

A more general decoding model again assumes equally distributed speakers around the origin with a distance $r_l$ radiating point like spherical waves. The Ambisonics coefficients $A_n^m$ are given by the general description from Eq. (1) and the sound pressure generated by L loudspeakers is given according to Eq. (19):

$$A_n^m = \sum_{l=1}^{L} 4\pi \frac{h_n(kr_l)}{h_0(kr_l)} w_l Y_n^m(\theta_l, \phi_l)^* \tag{23}$$

A more sophisticated decoder can filter the Ambisonics coefficients $A_n^m$ in order to retrieve $$C_n^m = A_n^m \frac{h_0(kr_l)}{4\pi h_n(kr_l)}$$

and thereafter apply Eq. (17) with $d=[C_0^0,C_1^{-1},C_0^0,C_1^1,C_2^{-2},C_2^{-1},C_2^0,C_2^1,C_2^2, \ldots]'$ for deriving the speaker weights. With this model the speaker signals $w_l$ are determined by the pressure in the origin. There is an alternative approach which uses the simple source approach first described in the above-mentioned article "Three-dimensional surround sound systems based on spherical harmonics". The loudspeakers are assumed to be equally distributed on the sphere and to have secondary source characteristics. The solution is derived in Jens Ahrens, Sascha Spors, "Analytical driving functions for higher order ambisonics", Proceedings of the ICASSP, pages 373-376, 2008, Eq. (13), which may be rewritten for truncation at Ambisonics order N and a loudspeaker gain $g_l$ as a generalisation:

$$w_l = \sum_{n=0}^{N} \sum_{m=-n}^{n} g_l \frac{A_n^m}{kr_l h_n^{(2)}(kr_l)} Y_n^m(\theta_l, \phi_l) \tag{24}$$

Distance Coded Ambisonics Signals

Creating $C_n^m$ at the Ambisonics encoder using a reference speaker distance $r_{l_ref}$ can solve numerical problems of $A_n^m$ when modeling or recording spherical waves (using Eq. (18)):

$$C_n^m = A_n^m \frac{h_0(kr_{l_ref})}{4\pi h_n(kr_{l_ref})} = \frac{h_0(kr_{l_ref})}{h_n(kr_{l_ref})} \frac{h_n(kr_s)}{h_0(kr_s)} P_{S_0} Y_n^m(\theta_s, \phi_s)^* \tag{25}$$

Transmitted or stored are $C_n^m$, the reference distance $r_{l_ref}$ and an indicator that spherical distance coded coefficients are used. At decoder side, a simple decoding processing as given in Eq. (22) is feasible as long as the real speaker distance $r_l \approx r_{l_ref}$. If that difference is too large, a correction $$D_n^m = C_n^m \frac{h_n(kr_{l_ref})}{h_n(kr_l)} \tag{26}$$

by filtering before the Ambisonics decoding is required.

Other decoding models like Eq. (24) result in different formulations for distance coded Ambisonics:

$$\tilde{C}_n^m = \frac{A_n^m}{kr_{l_ref}\, h_n(kr_{l_ref})} = \frac{1}{kr_{l_ref}\, h_n(kr_{l_ref})} \frac{h_n(kr_s)}{h_0(kr_s)} P_{S_0} Y_n^m(\theta_s, \phi_s)^* \tag{27}$$

Also the normalisation of the Spherical Harmonics can have an influence of the formulation of distance coded Ambisonics, i.e. Distance Coded Ambisonics coefficients need a defined context.

The details for the above-mentioned 2D-3D conversion are as follows:

The conversion factor $$\alpha_{\frac{2D}{3D}}$$

to convert a 2D circular component into a 3D spherical component by multiplication, can be derived as follows:

$$\alpha_{\frac{2D}{3D}} = \frac{s_{n=m}^m(\theta = \pi/2, \Phi)}{\bar{\Phi}_{n=|m|}^m(\phi)} = \frac{\tilde{N}_{m,m}}{N_m} \frac{P_{|m|,|m|}(\cos(\theta = \pi/2))\Phi_m(\phi)}{\Phi_m(\phi)} \tag{28}$$

Using the common identity (cf. Wikipedia as of 12 Oct. 2010, "Associated Legendre polynomials", http://en.wikipedia.org/w/index.php?title=Associated_Legendre_polynomials&oldid=363001), $P_{l,l}(x)=(2l-1)!!(1-x^2)^{l/2}$, where $(2l-1)!!=\Pi_{i=1}^{l}(2i-1)$ is double factorial and $P_{|m|,|m|}$ can be expressed as:

$$P_{|m|,|m|}(\cos(\theta = \pi/2)) = (2m-1)!! = \frac{(2m)!}{m!2^m} \tag{29}$$

Eq. (29) inserted into Eq. (28) leads to Eq. (10).

Conversion from 2D to ortho-3D is derived by $$\alpha_{\frac{N2D}{ortho3D}} = \sqrt{\frac{(2m+1)}{4\pi(2m)!}} \frac{(2m)!}{m!2^m} = \sqrt{\frac{(2m+1)(2m)!}{4\pi m!^2 2^{2m}}} = \sqrt{\frac{(2m+1)!}{4\pi m!^2 2^{2m}}}, \tag{30}$$

using relation $$l! = \frac{(l+1)!}{l+1}$$

and substituting l=2m.

The details for the above-mentioned Spherical Wave expansion are as follows:

Solving Eq. (1) for spherical waves, which are generated by point sources for $r<r_s$ and incoming waves, is more complicated because point sources with vanishing infinitesimal size need to be described using a volume flow $Q_S$, wherein the radiated pressure for a field point at r and the source positioned at $r_s$ is given by (cf. the above-mentioned book "Fourier Acoustics"):

$$p(r|r_s) = -i\rho_0 ckQ_S G(r|r_s) \tag{31}$$

with $\rho_0$ being the specific density and $G(r|r_s)$ being Green's function $$G(r \mid r_s) = \frac{e^{-ik|r-r_s|}}{4\pi|r-r_s|} \tag{32}$$

$G(r|r_s)$ can also be expressed in spherical harmonics for $r<r_s$ by $$G(r|r_s) = ik\Sigma_{n=0}^{\infty}\Sigma_{m=-n}^{n} j_n(kr)h_n^{(2)}(kr_s)Y_n^m(\theta,\phi)Y_n^m(\Theta_s, \phi_s)^* \tag{33}$$

wherein $h_n^{(2)}$ is the Hankel function of second kind. Note that the Green's function has a scale of unit meter$^{-1}$ (1/m due to k). Eqs. (31),(33) can be compared to Eq. (1) for deriving the Ambisonics coefficients of spherical waves:

$$A_{n_{sperical}}^m(k,\Theta_s,\phi_s,r_s) = \rho_0 ck^2 Q_S h_n^{(2)}(kr_s)Y_n^m(\Theta_s,\phi_s)^* \tag{34}$$

where $Q_S$ is the volume flow in unit $m^3s^{-1}$, and $\rho_0$ is the specific density in kg $m^{-3}$.

To be able to synthetically create Ambisonics signals and to relate to the above plane wave considerations, it is sensible to express Eq. (34) using the sound pressure generated at the origin of the coordinate system:

$$P_{S_0} = p(0 \mid r_s) = \frac{-i\rho_0 ckQ_S}{4\pi} \frac{e^{-ikr_s}}{r_s} = \frac{\rho_0 ck^2 Q_S}{4\pi} h_0^{(2)}(kr_s) \tag{35}$$

which leads to $$A_{n_{sperical}}^m(k, \Theta_s, \phi_s, r_s) = 4\pi \frac{h_n^{(2)}(kr_s)}{h_0^{(2)}(kr_s)} P_{S_0} Y_n^m(\Theta_s, \phi_s)^* \tag{36}$$

Exchange Storage Format

The storage format according to the invention allows storing more than one HOA representation and additional directional streams together in one data container. It enables different formats of HOA descriptions which enable decoders to optimise reproduction, and it offers an efficient data storage for sizes >4 GB. Further advantages are:

A) By the storage of several HOA descriptions using different formats together with related storage format information an Ambisonics decoder is able to mix and decode both representations.

B) Information items required for next-generation HOA decoders are stored as format information:

- Dimensionality, region of interest (sources outside or within the listening area), normalisation of spherical basis functions;
- Ambisonics coefficient packing and scaling information;
- Ambisonics wave type (plane, spherical), reference radius (for decoding of spherical waves);

Related directional mono signals may be stored. Position information of these directional signals can be described using either angle and distance information or an encoding-vector of Ambisonics coefficients.

C) The storage format of Ambisonics data is extended to allow for a flexible and economical storage of data:

Storing Ambisonics data related to the Ambisonics components (Ambisonics channels) with different PCM-word size resolution;

Storing Ambisonics data with reduced bandwidth using either re-sampling or an MDCT processing.

D) Metadata fields are available for associating tracks for special decoding (frontal, ambient) and for allowing storage of accompanying information about the file, like recording information for microphone signals:

Recording reference coordinate system, microphone, source and virtual listener positions, microphone directional characteristics, room and source information.

E) The format is suitable for storage of multiple frames containing different tracks, allowing audio scene changes without a scene description. (Remark: one track contains a HOA sound field description or a single source with position information. A frame is the combination of one or more parallel tracks.) Tracks may start at the beginning of a frame or end at the end of a frame, therefore no time code is required.

F) The format facilitates fast access of audio track data (fast-forward or jumping to cue points) and determining a time code relative to the time of the beginning of file data.

HOA Parameters for HOA Data Exchange

Table 6 summarises the parameters required to be defined for a non-ambiguous exchange of HOA signal data. The definition of the spherical harmonics is fixed for the complex-valued and the real-valued cases, cf. Eqs. (3)(6).

TABLE 6

Parameters for non ambiguous exchange of HOA recordings

| | | |
|---|---|---|
| Context | Dimensionality | 2D/3D, influences also packing of Ambisonics coefficients (AC) |
| | Region of Interest | FIG. 6, FIG. 8, Eqs. (1) (2) |
| | SH type | Complex, real valued, circular for 2D |
| | SH normalisation | SN3D, N3D, ortho-normalised |
| Ambisonics-coefficient | AC weighting | B-Format, FuMa, maxN, no weighting, user defined |
| | AC sequence and sample resolution | Examples in Eqs. (12) (13), resolution 16/24 bit or float types. |
| | AC type | Unspecified $A_n^m$, plane wave type $d_n^m$, Eq. (16), distance coded types $D_n^m$ or $\grave{C}_n^m$, Eqs. (26) (27) |

File Format Details

In the following, the file format for storing audio scenes composed of Higher Order Ambisonics (HOA) or single sources with position information is described in detail. The audio scene can contain multiple HOA sequences which can use different normalisation schemes. Thus, a decoder can compute the corresponding loudspeaker signals for the desired loudspeaker setup as a superposition of all audio tracks from a current file. The file contains all data required for decoding the audio content. The file format according to the invention offers the feature of storing more than one HOA or single source signal in single file. The file format uses a composition of frames, each of which can contain several tracks, wherein the data of a track is stored in one or more packets called TrackPackets.

All integer types are stored in little-endian byte order so that the least significant byte comes first. The bit order is always most significant bit first. The notation for integer data types is 'int'. A leading 'u' indicates unsigned integer. The resolution in bit is written at the end of the definition. For example, an unsigned 16 bit integer field is defined as 'uint16'. PCM samples and HOA coefficients in integer format are represented as fix point numbers with the decimal point at the most significant bit.

All floating point data types conform to the IEEE specification IEEE-754, "Standard for binary floating-point arithmetic", http://grouper.ieee.org/groups/754/. The notation for the floating point data type is 'float'. The resolution in bit is written at the end of the definition. For example, a 32 bit floating point field is defined as 'float32'. Constant identifiers ID, which identify the beginning of a frame, track or chunk, and strings are defined as data type byte. The byte order of byte arrays is most significant byte and bit first. Therefore the ID 'TRCK' is defined in a 32-bit byte field wherein the bytes are written in the physical order 'T', 'R', 'C' and 'K' (<0x54; 0x52; 0x42; 0x4b>). Hexadecimal values start with '0x' (e.g. 0xAB64C5). Single bits are put into quotation marks (e.g. '1'), and multiple binary values start with '0b' (e.g. 0b0011=0x3).

Header field names always start with the header name followed by the field name, wherein the first letter of each word is capitalised (e.g. TrackHeaderSize). Abbreviations of fields or header names are created by using the capitalised letters only (e.g. TrackHeaderSize=THS).

The HOA File Format can include more than one Frame, Packet or Track. For the discrimination of multiple header fields a number can follow the field or header name. For example, the second TrackPacket of the third Track is named 'Track3Packet2'.

The HOA file format can include complex-valued fields. These complex values are stored as real and imaginary part wherein the real part is written first. The complex number 1+i2 in 'int8' format would be stored as '0x01' followed by '0x02'. Hence fields or coefficients in a complex-value format type require twice the storage size as compared to the corresponding real-value format type.

Higher Order Ambisonics File Format Structure

Single Track Format

The Higher Order Ambisonics file format includes at least one FileHeader, one FrameHeader, one TrackHeader and one TrackPacket as depicted in FIG. 9, which shows a simple example HOA file format file that carries one Track in one or more Packets.

Therefore the basic structure of a HOA file is one FileHeader followed by a Frame that includes at least one Track. A Track consists always of a TrackHeader and one or more TrackPackets.

Multiple Frame and Track Format

In contrast to the FileHeader, the HOA File can contain more than one Frame, wherein a Frame can contain more than one Track. A new FrameHeader is used if the maximal size of a Frame is exceeded or Tracks are added, or removed from one Frame to the other. The structure of a multiple Track and Frame HOA File is shown in FIG. 10.

The structure of a multiple Track Frame starts with the FrameHeader followed by all TrackHeaders of the Frame.

Consequently, the TrackPackets of each Track are sent successively to the FrameHeaders, wherein the TrackPackets are interleaved in the same order as the TrackHeaders.

In a multiple Track Frame the length of a Packet in samples is defined in the FrameHeader and is constant for all Tracks. Furthermore, the samples of each Track are synchronised, e.g. the samples of Track1Packet1 are synchronous to the samples of Track2Packet1. Specific TrackCodingTypes can cause a delay at decoder side, and such specific delay needs to be known at decoder side, or is to be included in the TrackCodingType dependent part of the TrackHeader, because the decoder synchronises all TrackPackets to the maximal delay of all Tracks of a Frame.

File Dependent Meta Data

Meta data that refer to the complete HOA File can optionally be added after the FileHeader in MetaDataChunks. A MetaDataChunk starts with a specific General User ID (GUID) followed by the MetaDataChunkSize. The essence of the MetaDataChunk, e.g. the Meta Data information, is packed into an XML format or any user-defined format. FIG. 11 shows the structure of a HOA file format using several MetaDataChunks.

Track Types

A Track of the HOA Format differentiates between a general HOATrack and a SingleSourceTrack. The HOATrack includes the complete sound field coded as HOACoefficients. Therefore, a scene description, e.g. the positions of the encoded sources, is not required for decoding the coefficients at decoder side. In other words, an audio scene is stored within the HOACoefficients.

Contrary to the HOATrack, the SingleSourceTrack includes only one source coded as PCM samples together with the position of the source within an audio scene. Over time, the position of the SingleSourceTrack can be fixed or variable. The source position is sent as TrackHOAEncodingVector or TrackPositionVector. The TrackHOAEncodingVector contains the HOA encoding values for obtaining the HOACoefficient for each sample. The TrackPositionVector contains the position of the source as angle and distance with respect to the centre listening position.

File Header

| Field Name | Size/ Bit | Data Type | Description |
|---|---|---|---|
| FileID | 32 | byte | The constant file identifier for the HOA File Format: <“H”; “O”; “A”; “F”> or <0x48; 0x4F; 0x41; 0x46> |
| FileVersionNumber | 8 | uint8 | Version number of the HOA Format 0-255 |
| FileSampleRate | 32 | uint32 | Sample Rate in Hs constant for all Frames and Tracks |
| FileNumberOfFrames | 32 | uint32 | Total Number of Frames at least ‘1’ is required |
| reserved | 8 | byte | |
| Total Number of Bits | 112 | | |

The FileHeader includes all constant information for the complete HOA File. The FileID is used for identifying the HOA File Format. The sample rate is constant for all Tracks even if it is sent in the FrameHeader. HOA Files that change their sample rate from one frame to another are invalid. The number of Frames is indicated in the FileHeader to indicate the Frame structure to the decoder.

Meta Data Chunks

| Field Name | Size/ Bit | Data Type | Description |
|---|---|---|---|
| ChunkID | 32 | byte | General User ID (not defined yet) |
| ChunkSize | 32 | uint32 | Size of the chunk in byte excluding the ChunkID and the ChunkSize field |
| ChunkData | 8 * Chunk-Size | byte | User defined Fields or XML-structure depending on the ChunkID |
| Total Number of Bits | 64 + 8 * ChunkSize | | |

Frame Header

| Field Name | Size/ Bit | Data Type | Description |
|---|---|---|---|
| FrameID | 32 | byte | The constant identifier for all FrameHeader: <“F”; “R”; “A”; “M”> or <0x46; 0x52; 0x41; 0x4D> |
| FrameSize | 32 | uint32 | Size of the Frame in Byte excluding the FrameID and the FrameSize field |
| FrameNumber | 32 | uint32 | A unique FrameNumber that start with 0 for the first Frame and increases for following Frames. The last Frame has the FrameNumber FileNumberOfFrame-1. |
| FrameNumberOfSamples | 32 | uint32 | Number of samples stored in each Track of the Frame |
| FrameNumberOfTracks | 8 | uint8 | Number of Tracks stored within the Frame |
| FramePacketSize | 32 | uint32 | The size of a Packet in samples. The packet size is constant for all Tracks. |
| FrameSampleRate | 32 | uint32 | Sample Rate in Hs constant for all Frames and Tracks has to be identical to the FileSampleRate (Redefinition for Streaming applications where the FileHeader could be unknown) |
| Total Number of Bits | 200 | | |

The FrameHeader holds the constant information of all Tracks of a Frame and indicates changes within the HOA File. The FrameID and the FrameSize indicate the beginning of a Frame and the length of the Frame. These two fields allow an easy access of each frame and a crosscheck of the Frame structure. If the Frame length requires more than 32 bit, one Frame can be separated in several Frames. Each Frame has a unique FrameNumber. The FrameNumber should start with 0 and should be incremented by one for each new Frame.

The number of samples of the Frame is constant for all Tracks of a Frame. The number of Tracks within the Frame is constant for the Frame. A new Frame Header is sent for ending or starting Tracks at a desired sample position. The samples of each Track are stored in Packets. The size of these TrackPackets is indicated in samples and is constant for all Tracks. The number of Packets is equal to the integer number that is required for storing the number of samples of the Frame. Therefore the last Packet of a Track can contain fewer samples than the indicated Packet size. The sample rate of a frame is equal to the FileSampleRate and is indicated in the FrameHeader to allow decoding of a Frame without knowledge of the FileHeader. This can be used when decoding from the middle of a multi frame file without knowledge of the FileHeader, e.g. for streaming applications.

Track Header

| Field Name | Size/ Bit | Data Type | Description |
|---|---|---|---|
| TrackID | 32 | byte | The constant identifier for all TrackHeader: <“T”; “R”; “A”; “C”> or <0x54; 0x52; 0x41; 0x43> |
| TrackNumber | 16 | uint16 | A unique TrackNumber for the identification of coherent Tracks in several Frames |
| TrackHeaderSize | 32 | uint32 | Size of the TrackHeader excluding the TrackID and TrackNumber field (Offset to the beginning of the next TrackHeader or first TrackPacket) |
| TrackMetaDataOffset | 32 | uint32 | Offset from the end of this field to the beginning of the TrackMetaData field. Zeros is equal to no TrackMetaData included. |
| TrackSourceType | 1 | binary | ‘0’ = HOATrack and ‘1’ = SingleSourceTrack |
| reserved | 7 | binary | 0b0000000 |
| Condition: TrackSourceType == ‘0’ | | | TrackHeader for HOA Tracks |
| <HOATrackHeader> | dyn | byte | see section HOA TrackHeader |
| Condition: TrackSourceType == ‘1’ | | | TrackHeader for SingleSourceTracks |
| <SingleSourceTrack-Header> | dyn | byte | see sections Single Source fixed Position Track Header and Single Source moving Position Track Header |
| Condition: TrackMetaDataOffset > 0 | | | |
| TrackMetaData | dyn | byte | XML field for Track dependent MetaData see TrackMetaData table |
| Total Number of Bits | 120 + dyn | | |

The term ‘dyn’ refers to a dynamic field size due to conditional fields. The TrackHeader holds the constant information for the Packets of the specific Track. The TrackHeader is separated into a constant part and a variable part for two TrackSourceTypes. The TrackHeader starts with a constant TrackID for verification and identification of the beginning of the TrackHeader. A unique TrackNumber is assigned to each Track to indicate coherent Tracks over Frame borders. Thus, a track with the same TrackNumber can occur in the following frame. The TrackHeaderSize is provided for skipping to the next TrackHeader and it is indicated as an offset from the end of the TrackHeaderSize field. The TrackMetaDataOffset provides the number of samples to jump directly to the beginning of the TrackMetaData field, which can be used for skipping the variable length part of the TrackHeader. A TrackMetaDataOffset of zero indicates that the TrackMetaData field does not exist. Reliant on the TrackSourceType, the HOATrackHeader or the SingleSourceTrackHeader is provided. The HOATrackHeader provides the side information for standard HOA coefficients that describe the complete sound field. The SingleSourceTrackHeader holds information for the samples of a mono PCM track and the position of the source. For SingleSourceTracks the decoder has to include the Tracks into the scene.

At the end of the TrackHeader an optional TrackMetaData field is defined which uses the XML format for providing track dependent Metadata, e.g. additional information for A-format transmission (microphone-array signals).

HOA Track Header

| Field Name | Size/ Bit | Data Type | Description | |
|---|---|---|---|---|
| TrackComplexValueFlag | 2 | binary | 0b00: real part only<br>0b01: real and imaginary part<br>0b10: imaginary part only<br>0b11 reserved | |
| TrackSampleFormat | 4 | binary | 0b0000 | Unsigned Integer 8 bit |
| | | | 0b0001 | Signed Integer 8 bit |
| | | | 0b0010 | Signed Integer 16 bit |
| | | | 0b0011 | Signed Integer 24 bit |
| | | | 0b0100 | Signed Integer 32 bit |
| | | | 0b0101 | Signed Integer 64 bit |
| | | | 0b0110 | Float 32 bit (binary single prec.) |
| | | | 0b0111 | Float 64 bit (binary double prec.) |
| | | | 0b1000 | Float 128 bit (binary quad prec.) |
| | | | 0b1001-0b1111 | reserved |
| reserved | 2 | binary | fill bits | |
| TrackHOAParams | dyn | bytes | see TrackHOAParams | |
| TrackCodingType | 8 | unit8 | ‚0' | The HOA coefficients are coded as PCM samples with constant bit resolution and constant frequency resolution. |
| | | | ‚1' | The HOA coefficients are coded with an order dependent bit resolution and frequency resolution |
| | | | else | reserved for further coding types |
| Condition: TrackCodingType == '1' | | | Side information for coding type 1 | |
| TrackBandwidthReductionType | 8 | unit8 | 0 | full bandwidth for all orders |
| | | | 1 | Bandwidth reduction via MDCT |
| | | | 2 | Bandwidth reduction via time domain filter |
| TrackNumberOfOrderRegions | 8 | unit8 | The bandwidth and bit resolution can be adapted for a number of regions wherein each number has a start and end order. TrackNumberOfOrderRegions indicates the number of defined regions. | |
| | | | Write the following fields for each region | |
| TrackRegionFirstOrder | 8 | unit8 | First order of the region | |
| TrackRegionLastOrder | 8 | unit8 | Last order of this region | |
| TrackRegionSampleFormat | 4 | binary | 0b0000 | Unsigned Integer 8 bit |
| | | | 0b0001 | Signed Integer 8 bit |
| | | | 0b0010 | Signed Integer 16 bit |
| | | | 0b0011 | Signed Integer 24 bit |
| | | | 0b0100 | Signed Integer 32 bit |
| | | | 0b0101 | Signed Integer 64 bit |
| | | | 0b0110 | Float 32 bit (binary single prec.) |
| | | | 0b0111 | Float 64 bit (binary double prec.) |
| | | | 0b1000 | Float 128 bit (binary quad prec.) |
| | | | 0b1001-0b1111 | reserved |
| TrackRegionUseBandwidthReduction | 1 | binary | '0' | full Bandwidth for this region |
| | | | '1' | reduce bandwidth for this region with TrackBandwidthReductionType |
| reserved | 3 | binary | fill bits | |
| Condition: TrackRegionUseBandwidthReduction == '1' | | | Bandwidth is reduced in this region | |
| Condition: TrackBandwidthReductionType == 1 | | | Bandwidth reduction via MDCT side information | |
| TrackRegionWindowType | 8 | unit8 | 0: sine Window: $W(t) = \sin\left(\frac{\pi(t+0.5)}{N}\right)$<br>else: reserved | |
| TrackRegionFirstBin | 16 | unit16 | first coded MDCT bin (lower cut-off frequency) | |
| TrackRegionLastBin | 16 | unit16 | last coded MDCT bin (upper cut-off frequency) | |
| Condition: TrackBandwidthReductionType == 2 | | | Bandwidth reduction via time domain filter side information | |
| TrackRegionFilterLength | 16 | unit16 | Number of lowpass filter coefficients | |
| <TrackRegionFilterCoefficients> | dyn | float32 | TrackRegionFilterLength lowpass filter coefficients | |
| TrackRegionModulationFreq | 32 | float32 | Normalised modulation frequency $\Omega_{mod}/\pi$ required for shifting the signal spectra | |
| TrackRegionDownsampleFactor | 16 | unit16 | Downsampling factor M, must be a divider of FramePacketSize | |
| TrackReqionUpsampleFactor | 16 | unit16 | Upsampling factor K < M | |
| TrackRegionFilterDelay | 16 | unit16 | Delay in samples (according to FileSampleRate) of encoding/decoding bandwidth reduction processing | |

The HOATrackHeader is a part of the TrackHeader that holds information for decoding a HOATrack. The TrackPackets of a HOATrack transfer HOA coefficients that code the entire sound field of a Track. Basically the HOATrackHeader holds all HOA parameters that are required at decoder side for decoding the HOA coefficients for the given speaker setup. The TrackComplexValueFlag and the TrackSampleFormat define the format type of the HOA coefficients of each TrackPacket. For encoded or compressed coefficients the TrackSampleFormat defines the format of the decoded or uncompressed coefficients. All format types can be real or complex numbers. More information on complex numbers is provided in the above section File Format Details.

All HOA dependent information is defined in the TrackHOAParams. The TrackHOAParams are re-used in other TrackSourceTypes. Therefore, the fields of the TrackHOAParams are defined and described in section TrackHOAParams.

The TrackCodingType field indicates the coding (compression) format of the HOA coefficients. The basic version of the HOA file format includes e.g. two CodingTypes.

One CodingType is the PCM coding type (TrackCodingType=='0'), wherein the uncompressed real or complex coefficients are written into the packets in the selected TrackSampleFormat. The order and the normalisation of the HOA coefficients are defined in the TrackHOAParams fields.

A second CodingType allows a change of the sample format and to limit the bandwidth of the coefficients of each HOA order. A detailed description of that CodingType is provided in section TrackRegion Coding, a short explanation follows: The TrackBandwidthReductionType determines the type of processing that has been used to limit the bandwidth of each HOA order. If the bandwidth of all coefficients is unaltered, the bandwidth reduction can be switched off by setting the TrackBandwidthReductionType field to zero. Two other bandwidth reduction processing types are defined. The format includes a frequency domain MDCT processing and optionally a time domain filter processing. For more information on the MDCT processing see section Bandwidth reduction via MDCT.

The HOA orders can be combined into regions of same sample format and bandwidth. The number of regions is indicated by the TrackNumberOfOrderRegions field. For each region the first and last order index, the sample format and the optional bandwidth reduction information has to be defined. A region will obtain at least one order. Orders that are not covered by any region are coded with full bandwidth using the standard format indicated in the TrackSampleFormat field. A special case is the use of no region (TrackNumberOfOrderRegions==0). This case can be used for deinterleaved HOA coefficients in PCM format, wherein the HOA components are not interleaved per sample. The HOA coefficients of the orders of a region are coded in the TrackRegionSampleFormat. The TrackRegionUseBandwidthReduction indicates the usage of the bandwidth reduction processing for the coefficients of the orders of the region. If the TrackRegionUseBandwidthReduction flag is set, the bandwidth reduction side information will follow. For the MDCT processing the window type and the first and last coded MDCT bin are defined. Hereby the first bin is equivalent to the lower cut-off frequency and the last bin defines the upper cut-off frequency. The MDCT bins are also coded in the TrackRegionSampleFormat, cf. section Bandwidth reduction via MDCT.

Single Source Type

Single Sources are subdivided into fixed position and moving position sources. The source type is indicated in the TrackMovingSourceFlag. The difference between the moving and the fixed position source type is that the position of the fixed source is indicated only once in the TrackHeader and in each TrackPackage for moving sources. The position of a source can be indicated explicitly with the position vector in spherical coordinates or implicitly as HOA encoding vector. The source itself is a PCM mono track that has to be encoded to HOA coefficients at decoder side in case of using an Ambisonics decoder for playback.

Single Source Fixed Position Track Header

| Field Name | Size/ Bit | Data Type | Description | |
|---|---|---|---|---|
| TrackMovingSourceFlag | 1 | binary | constant '0' for fixed sources | |
| TrackPositionType | 1 | binary | '0' | Position is sent as angle Position TrackPositionVector [R, theta, phi] |
| | | | '1' | Position is sent as HOA encoding vector of length TrackHOAParamNumberOfCoeffs |
| TrackSampleFormat | 4 | binary | 0b0000 | Unsigned Integer 8 bit |
| | | | 0b0001 | Signed Integer 8 bit |
| | | | 0b0010 | Signed Integer 16 bit |
| | | | 0b0011 | Signed Integer 24 bit |
| | | | 0b0100 | Signed Integer 32 bit |
| | | | 0b0101 | Signed Integer 64 bit |
| | | | 0b0110 | Float 32 bit (binary single prec.) |
| | | | 0b0111 | Float 64 bit (binary double prec.) |
| | | | 0b1000 | Float 128 bit (binary quad prec.) |
| | | | 0b1001-0b1111 | reserved |
| reserved | 2 | binary | fill bits | |
| Condition: TrackPositionType == '0' | | | Position as angle TrackPositionVector follows | |
| TrackPositionTheta | 32 | float32 | inclination in rad [0 . . . pi] | |
| TrackPositionPhi | 32 | float32 | azimuth (counter-clockwise) in rad [0 . . . 2pi] | |
| TrackPositionRadius | 32 | float32 | Distance from reference point in meter | |
| Condition: TrackPositionType == '1' | | | Position as HOA encoding vector | |
| TrackHOAParams | dyn | bytes | see TrackHOAParams | |
| TrackEncodeVectorComplexFlag | 2 | binary | 0b00: real part only | |
| | | | 0b01: real and imaginary part | |
| | | | 0b10: imaginary part only | |

-continued

| | | | | |
|---|---|---|---|---|
| | | | 0b11: reserved | |
| | | | Number type for encoding Vector | |
| TrackEncodeVectorFormat | 1 | binary | '0' | float32 |
| | | | '1' | float64 |
| reserved | 5 | binary | fill bits | |
| Condition: TrackEncodeVectorFormat == '0' | | | encoding vector as float32 | |
| <TrackHOAEncodingVector> | dyn | float32 | TrackHOAParamNumberOfCoeffs entries of the HOA encoding vector in TrackHOAParamCoeffSequence order | |
| Condition: TrackEncodeVectorFormat == '1' | | | encoding vector as float64 | |
| <TrackHOAEncodingVector> | dyn | float64 | TrackHOAParamNumberOfCoeffs entries of the HOA encoding vector in TrackHOAParamCoeffSequence order | |

The fixed position source type is defined by a TrackMovingSourceFlag of zero. The second field indicates the TrackPositionType that gives the coding of the source position as vector in spherical coordinates or as HOA encoding vector. The coding format of the mono PCM samples is indicated by the TrackSampleFormat field. If the source position is sent as TrackPositionVector, the spherical coordinates of the source position are defined in the fields TrackPositionTheta (inclination from s-axis to the x-, y-plane), TrackPositionPhi (azimuth counter clockwise starting at x-axis) and TrackPositionRadius.

If the source position is defined as an HOA encoding vector, the TrackHOAParams are defined first. These parameters are defined in section TrackHOAParams and indicate the used normalisations and definitions of the HOA encoding vector. The TrackEncodeVectorComplexFlag and the TrackEncodeVectorFormat field define the format type of the following TrackHOAEncoding vector. The TrackHOAEncodingVector consists of TrackHOAParamNumberOfCoeffs values that are either coded in the 'float32' or 'float64' format.

Single Source Moving Position Track Header

| Field Name | Size/ Bit | Data Type | Description | |
|---|---|---|---|---|
| TrackMovingSourceFlag | 1 | binary | constant '1' for moving sources | |
| TrackPositionType | 1 | binary | '0' | Position is sent as angle TrackPositionVector [R, theta, phi] |
| | | | '1' | Position is sent as HOA encoding vector of length TrackHOAParamNumberOfCoeffs |
| TrackSampleFormat | 4 | binary | 0b0000 | Unsigned Integer 8 bit |
| | | | 0b0001 | Signed Integer 8 bit |
| | | | 0b0010 | Signed Integer 16 bit |
| | | | 0b0011 | Signed Integer 24 bit |
| | | | 0b0100 | Signed Integer 32 bit |
| | | | 0b0101 | Signed Integer 64 bit |
| | | | 0b0110 | Float 32 bit (binary single prec.) |
| | | | 0b0111 | Float 64 bit (binary double prec.) |
| | | | 0b1000 | Float 128 bit (binary quad prec.) |
| | | | 0b1001-0b1111 | reserved |
| reserved | 2 | binary | fill bits | |
| Condition: TrackPositionType == '1' | | | Position as HOA encoding vector | |
| TrackHOAParams | dyn | bytes | see TrackHOAParams | |
| TrackEncodeVectorComplexFlag | 2 | binary | 0b00: real part only | |
| | | | 0b01: real and imaginary part | |
| | | | 0b10: imaginary part only | |
| | | | 0b11: reserved | |
| | | | Number type for encoding Vector | |
| TrackEncodeVectorFormat | 1 | binary | '0' | float32 |
| | | | '1' | float64 |
| reserved | 5 | binary | fill bits | |

The moving position source type is defined by a TrackMovingSourceFlag of '1'. The header is identical to the fix source header except that the source position data fields TrackPositionTheta, TrackPositionPhi, TrackPositionRadius and TrackHOAEncodingVector are absent. For moving sources these are located in the TrackPackets to indicate the new (moving) source position in each Packet.

Special Track Tables

TrackHOAParams

| Field Name | Size/ Bit | Data Type | Description | |
|---|---|---|---|---|
| TrackHOAParamDimension | 1 | binary | '0' = 2D and '1' = 3D | |
| TrackHOAParamRegionOfInterest | 1 | binary | '0' | HOA coefficients were computed for sources outside the region of interest (interior) |
| | | | '1' | HOA coefficients were computed for sources inside the region of interest (exterior) |
| | | | (The region of interest doesn't contain any sources.) | |
| TrackHOAParamSphericalHarmonicType | 1 | binary | '0' | real |
| | | | '1' | complex |
| TrackHOAParamSphericalHarmonicNorm | 3 | binary | 0b000 | not normalised |
| | | | 0b001 | Schmidt semi-normalised |
| | | | 0b010 | 4 π normalised or 2D normalised |
| | | | 0b011 | Ortho - normalised |
| | | | 0b100 | Dedicated Scaling |
| | | | other Rsrvd | |
| TrackHOAParamFurseMalhamFlag | 1 | binary | Indicates that the HOA coefficients are normalised by the Furse-Malham scaling | |
| TrackHOAParamDecoderType | 2 | binary | 0b00 | plane waves decoder scaling: $1/(4\pi i^n)$ |
| | | | 0b01 | spherical waves decoder scaling (distance coding): $1/(ikh_n(kr_{ls}))$ |
| | | | 0b10 | spherical waves decoder scaling (distance coding for measured sound pressure): $h_0(kr_{ls})/(ikh_n(kr_{ls}))$ |
| | | | 0b11 | plain HOA coefficients |
| TrackHOAParamCoeffSequence | 2 | | 0b00 | B-Format order |
| | | | 0b01 | numerical upward |
| | | | 0b10 | numerical downward |
| | | | 0b11 | Rsrvd |
| reserved | 5 | binary | fill bits | |
| TrackHOAParamNumberOfCoeffs | 16 | uint16 | Number of HOA Coefficients per sample minus 1 | |
| TrackHOAParamHorizontalOrder | 8 | uint8 | Ambisonics Order in the X/Y plane | |
| TrackHOAParamVerticalOrder | 8 | uint8 | Ambisonics Order for the 3D dimension ('0' for 2D HOA coefficients) | |
| Condition: TrackHOAParamSphericalHarmonicNorm == "dedicated" <0b101> | | | Field for dedicated Scaling Values for each HOA Coefficient | |
| TrackComplexValueScalingFlag | 2 | binary | 0b00: real part only<br>0b01: real and imaginary part<br>0b10: imaginary part only<br>0b11: reserved | |
| | | | Number type for dedicated TrackScalingValues | |
| TrackScalingFormat | 1 | binary | '0': float32<br>'1': float64 | |
| reserved | 5 | binary | fill bits | |
| Condition: TrackScalingFormat = '0' | TrackScalingFactors as float32 | | | |
| <TrackScalingFactors> | dyn | float32 | TrackHOAParamNumberOfCoeffs Scaling Factors if TrackComplexValueScalingFlag == 0b01 the order of the complex number parts is <[real1, imaginary1], [real2, imaginary2], . . . , [realN, imaginary]> | |
| Condition: TrackScalingFormat = '1' | TrackScalingFactors as float64 | | | |
| <TrackScalingFactors> | dyn | float64 | TrackHOAParamNumberOfCoeffs Scaling Factors if TrackComplexValueScalingFlag == 0b01 the order of the complex number parts is <[real1, imaginary1], [real2, imaginary2], . . . , [realN, imaginary]> | |
| Condition: TrackHOAParamDecoderType == 0b01 ‖ TrackHOAParamDecoderType == 0b10 | | | The reference loudspeaker radius for distance coding is defined | |
| TrackHOAParamReferenceRadius | 16 | uint16 | This is the reference loudspeaker radius $r_{ls}$ in mm that has been applied to the HOA coefficients for a spherical wave decoder according to Poletti or Daniel. | |

Several approaches for HOA encoding and decoding have been discussed in the past. However, without any conclusion or agreement for coding HOA coefficients. Advantageously, the format according to the invention allows storage of most known HOA representations. The TrackHOAParams are defined to clarify which kind of normalisation and order sequence of coefficients has been used at the encoder side. These definitions have to be taken into account at decoder side for the mixing of HOA tracks and for applying the decoder matrix.

HOA coefficients can be applied for the complete three-dimensional sound field or only for the two-dimensional x/y-plane. The dimension of the HOATrack is defined by the TrackHOAParamDimension field.

The TrackHOAParamRegionOfInterest reflects two sound pressure expansions in series whereby the sources reside inside or outside the region of interest, and the region of interest does not contain any sources. The computation of the sound pressure for the interior and exterior cases is defined in above equations (1) and (2), respectively, whereby the directional information of the HOA signal $A_n^m(k)$ is determined by the conjugated complex spherical harmonic tion$Y_n^m(\theta,\phi)^*$. This function is defined in a complex and the real number version. Encoder and decoder have to apply the spherical harmonic function of equivalent number type. Therefore the TrackHOAParamSphericalHarmonicType indicates which kind of spherical harmonic function has been applied at encoder side.

As mentioned above, basically the spherical harmonic function is defined by the associated Legendre functions and a complex or real trigonometric function. The associated Legendre functions are defined by Eq. (5). The complex-valued spherical harmonic representation is $$Y_n^m(\theta,\phi) = N_{n,m}P_{n,|m|}(\cos(\theta))e^{im\phi}\begin{cases}(-1)^m; & m \geq 0\\ 1; & m < 0\end{cases}$$

where $N_{n,m}$ is a scaling factor (cf. Eq. (3)). This complex-valued representation can be transformed into a real-valued representation using the following equation:

$$S_n^m(\theta,\phi) = \begin{cases}\frac{(-1)^m}{\sqrt{2}}(Y_n^m + Y_n^{m*}) = \tilde{N}_{n,m}P_{n,|m|}(\cos(\theta))\cos(m\phi), & m > 0\\ Y_n^0 = \tilde{N}_{n,m}P_{n,|m|}(\cos(\theta)) & m = 0\\ \frac{-1}{i\sqrt{2}}(Y_n^m - Y_n^{m*}) = \tilde{N}_{n,m}P_{n,|m|}(\cos(\theta))\sin(|m|\phi), & m < 0.\end{cases}$$

where the modified scaling factor for real-valued spherical harmonics is $$\tilde{N}_{n,m} = \sqrt{2-\delta_{0,m}}\,N_{n,m},$$

$$\delta_{0,m} = \begin{cases}1; & m = 0\\ 0; & m \neq 0.\end{cases}$$

For 2D representations the circular Harmonic function has to be used for encoding and decoding of the HOA coefficients. The complex-valued representation of the circular harmonic is defined by $\check{Y}(\phi)=\check{N}_m e^{im\Phi}$).

The real-valued representation of the circular harmonic is defined by $$\check{S}_m(\phi) = \check{\tilde{N}}_m\begin{cases}\cos(m\phi); & m \geq 0\\ \sin(|m|\phi); & m < 0.\end{cases}$$

Several normalisation factors $N_{n,m}$, $\tilde{N}_{n,m}$, $\check{N}_m$ and $\check{\tilde{N}}_m$ are used for adapting the spherical or circular harmonic functions to the specific applications or requirements. To ensure correct decoding of the HOA coefficients the normalisation of the spherical harmonic function used at encoder side has to be known at decoder side. The following Table 7 defines the normalisations that can be selected with the TrackHOAParamSphericalHarmonicNorm field.

TABLE 7

| Normalisations of spherical and circular harmonic functions | | | |
|---|---|---|---|
| 3D complex valued spherical harmonic normalisations $N_{n,m}$ | | | |
| Not normalised 0b000 | Schmidt semi normalised, SN3D 0b001 | 4π normalised, N3D, Geodesy 4π 0b010 | Ortho-normalised 0b011 |
| 1 | $\sqrt{\frac{(n-\lvert m\rvert)!}{(n+\lvert m\rvert)!}}$ | $\sqrt{\frac{(2n+1)(n-\lvert m\rvert)!}{(n+\lvert m\rvert)!}}$ | $\sqrt{\frac{(2n+1)(n-\lvert m\rvert)!}{4\pi(n+\lvert m\rvert)!}}$ |
| 3D real valued spherical harmonic normalisations $\tilde{N}_{n,m}$ | | | |
| Not normalised 0b000 | Schmidt semi normalised, SN3D 0b001 | 4π normalised, N3D, Geodesy 4π 0b010 | Ortho-normalised 0b011 |
| $\sqrt{2-\delta_{0,m}}$ | $\sqrt{(2-\delta_{0,m})\frac{(n-\lvert m\rvert)!}{(n+\lvert m\rvert)!}}$ | $\sqrt{(2-\delta_{0,m})\frac{(2n+1)(n-\lvert m\rvert)!}{(n+\lvert m\rvert)!}}$ | $\sqrt{(2-\delta_{0,m})\frac{(2n+1)(n-\lvert m\rvert)!}{4\pi(n+\lvert m\rvert)!}}$ |

TABLE 7-continued

| Normalisations of spherical and circular harmonic functions | | | |
|---|---|---|---|
| 2D complex valued circular harmonic normalisations $\check{N}_m$ | | | |
| Not normalised 0b000 | Schmidt semi normalised, SN2D 0b001 | 2D normalised, N2D, 0b010 | Ortho-normalised 0b011 |
| $\sqrt{\frac{1}{2}}$ | $\sqrt{\frac{1+\delta_{0,m}}{2}}$ | 1 | $\sqrt{\frac{1}{2\pi}}$ |
| 2D real valued circular harmonic normalisations $\check{N}_m$ | | | |
| Not normalised 0b000 | Schmidt semi normalised, SN2D 0b001 | 2D normalised, N2D, 0b010 | Ortho-normalised 0b011 |
| $\sqrt{\frac{2-\delta_{0,m}}{2}}$ | 1 | $\sqrt{(2-\delta_{0,m})}$ | $\sqrt{(2-\delta_{0,m})\frac{1}{2\pi}}$ |

For future normalisations the dedicated value of the TrackHOAParamSphericalHarmonicNorm field is available. For a dedicated normalisation the scaling factor for each HOA coefficient is defined at the end of the TrackHOAParams. The dedicated scaling factors TrackScalingFactors can be transmitted as real or complex 'float32' or 'float64' values. The scaling factor format is defined in the TrackComplexValueScalingFlag and TrackScalingFormat fields in case of dedicated scaling.

The Furse-Malham normalisation can be applied additionally to the coded HOA coefficients for equalising the amplitudes of the coefficients of different HOA orders to absolute values of less than 'one' for a transmission in integer format types. The Furse-Malham normalisation was designed for the SN3D real valued spherical harmonic function up to order three coefficients. Therefore it is recommended to use the Furse-Malham normalisation only in combination with the SN3D real-valued spherical harmonic function. Besides, the TrackHOAParamFurseMalhamFlag is ignored for Tracks with an HOA order greater than three. The Furse-Malham normalisation has to be inverted at decoder side for decoding the HOA coefficients. Table 8 defines the Furse-Malham coefficients.

TABLE 8

| Furse-Malham normalisation factors to be applied at encoder side | | |
|---|---|---|
| n | m | Furse-Malham weights |
| 0 | 0 | $\frac{1}{\sqrt{2}}$ |
| 1 | −1 | 1 |
| 1 | 0 | 1 |
| 1 | 1 | 1 |
| 2 | −2 | $\frac{2}{\sqrt{3}}$ |
| 2 | −1 | $\frac{2}{\sqrt{3}}$ |
| 2 | 0 | 1 |

TABLE 8-continued

| Furse-Malham normalisation factors to be applied at encoder side | | |
|---|---|---|
| n | m | Furse-Malham weights |
| 2 | 1 | $\frac{2}{\sqrt{3}}$ |
| 2 | 2 | $\frac{2}{\sqrt{3}}$ |
| 3 | −3 | $\sqrt{\frac{8}{5}}$ |
| 3 | −2 | $\frac{3}{\sqrt{5}}$ |
| 3 | −1 | $\sqrt{\frac{45}{32}}$ |
| 3 | 0 | 1 |
| 3 | 1 | $\sqrt{\frac{45}{32}}$ |
| 3 | 2 | $\frac{3}{\sqrt{5}}$ |
| 3 | 3 | $\sqrt{\frac{8}{5}}$ |

The TrackHOAParamDecoderType defines which kind of decoder is at encoder side assumed to be present at decoder side. The decoder type determines the loudspeaker model (spherical or plane wave) that is to be used at decoder side for rendering the sound field. Thereby the computational complexity of the decoder can be reduced by shifting parts of the decoder equation to the encoder equation. Additionally, numerical issues at encoder side can be reduced. Furthermore, the decoder can be reduced to an identical processing for all HOA coefficients because all inconsistencies at decoder side can be moved to the encoder. However, for spherical waves a constant distance of the loudspeakers from the listening position has to be assumed. Therefore the assumed decoder type is indicated in the TrackHeader, and the loudspeakers radius $r_{ls}$ for the spherical wave decoder types is transmitted in the optional field TrackHOAParamReferenceRadius in millimeters. An additional filter at decoder side can equalise the differences between the assumed and the real loudspeakers radius.

The TrackHOAParamDecoderType normalisation of the HOA coefficients $C_n^m$ depends on the usage of the interior or exterior sound field expansion in series selected in TrackHOAParamRegionOfInterest. Remark: coefficients $d_n^m$ in Eq. (18) and the following equations correspond to coefficients $C_n^m$ in the following. At encoder side the coefficients $C_n^m$ are determined from the coefficients $A_n^m$ or $B_n^m$ as defined in Table 9, and are stored. The used normalisation is indicated in the TrackHOAParamDecoderType field of the TrackHOAParam header:

TABLE 9

Transmitted HOA coefficients for several decoder type normalisations

| TrackHOAParamDecoderType | HOA Coefficients Interior | HOA Coefficients Exterior |
|---|---|---|
| 0b00: plane wave | $C_n^m = A_n^m/(4\pi i^n)$ | — |
| 0b01: spherical wave | $C_n^m = A_n^m/(ikh_n(kr_{ls}))$ | $C_n^m = A_n^m/(ikj_n(kr_{ls}))$ |
| 0b10: spherical wave measured sound pressure | $C_n^m = A_n^m h_0(kr_{ls})/(h_n(kr_{ls}))$ | $C_n^m = A_n^m h_0(kr_{ls})/(j_n(kr_{ls}))$ |
| 0b11: unnormalised | $C_n^m = A_n^m$ | $C_n^m = B_n^m$ |

The HOA coefficients for one time sample comprise TrackHOAParamNumberOfCoeffs(0) number of coefficients $C_n^m$. N depends on the dimension of the HOA coefficients. For 2D soundfields '0' is equal to 2N+1 where N is equal to the TrackHOAParamHorizontalOrder field from the TrackHOAParam header. The 2D HOA Coefficients are defined as $C_{|m|}^m = C_m$ with $-N \le m \le N$ and can be represented as a subset of the 3D coefficients as shown in Table 10.

For 3D sound fields 0 is equal to $(N+1)^2$ where N is equal to the TrackHOAParamVerticalOrder field from the TrackHOAParam header. The 3D HOA coefficients $C_n^m$ are defined for $0 \le n \le N$ and $-n \le m \le n$. A common representation of the HOA coefficients is given in Table 10:

TABLE 10

Representation of HOA coefficients up to fourth order showing the 2D coefficients in bold as a subset of the 3D coefficients

| | | | | | | | | |
|---|---|---|---|---|---|---|---|---|
| | | | | $\mathbf{C_0^0}$ | | | | |
| | | | $\mathbf{C_1^{-1}}$ | $C_1^0$ | $\mathbf{C_1^1}$ | | | |
| | | $\mathbf{C_2^{-2}}$ | $C_2^{-1}$ | $C_2^0$ | $C_2^1$ | $\mathbf{C_2^2}$ | | |
| | $\mathbf{C_3^{-3}}$ | $C_3^{-2}$ | $C_3^{-1}$ | $C_3^0$ | $C_3^1$ | $C_3^2$ | $\mathbf{C_3^3}$ | |
| $\mathbf{C_4^{-4}}$ | $C_4^{-3}$ | $C_4^{-2}$ | $C_4^{-1}$ | $C_4^0$ | $C_4^1$ | $C_4^2$ | $C_4^3$ | $\mathbf{C_4^4}$ |

In case of 3D sound fields and TrackHOAParamHorizontalOrder greater than TrackHOAParamVerticalOrder, the mixed-order decoding will be performed. In mixed-order-signals some higher-order coefficients are transmitted only in 2D. The TrackHOAParamVerticalOrder field determines the vertical order where all coefficients are transmitted. From the vertical order to the TrackHOAParamHorizontalOrder only the 2D coefficients are used. Thus the TrackHOAParamHorizontalOrder is equal or greater than the TrackHOAParamVerticalOrder. An example for a mixed-order representation of a horizontal order of four and a vertical order of two is depicted in Table 11:

TABLE 11

Representation of HOA coefficients for a mixed-order representation of vertical order two and horizontal order four.

| | | | | | | | | |
|---|---|---|---|---|---|---|---|---|
| | | | | $C_0^0$ | | | | |
| | | | $C_1^{-1}$ | $C_1^0$ | $C_1^1$ | | | |
| | | $C_2^{-2}$ | $C_2^{-1}$ | $C_2^0$ | $C_2^1$ | $C_2^2$ | | |
| | $C_3^{-3}$ | | | | | | $C_3^3$ | |
| $C_4^{-4}$ | | | | | | | | $C_4^4$ |

The HOA coefficients $C_n^m$ are stored in the Packets of a Track. The sequence of the coefficients, e.g. which coefficient comes first and which follow, has been defined differently in the past. Therefore, the field TrackHOAParamCoeffSequence indicates three types of coefficient sequences. The three sequences are derived from the HOA coefficient arrangement of Table 10.

The B-Format sequence uses a special wording for the HOA coefficients up to the order of three as shown in Table 12:

TABLE 12

B-Format HOA coefficients naming conventions

| | | | | | | |
|---|---|---|---|---|---|---|
| | | | W | | | |
| | | Y | S | X | | |
| | V | T | R | S | U | |
| Q | O | M | K | L | N | P |

For the B-Format the HOA coefficients are transmitted from the lowest to the highest order, wherein the HOA coefficients of each order are transmitted in alphabetic order. For example, the coefficients of a 3D setup of the HOA order three are stored in the sequence W, X, Y, S, R, S, T, U, V, K, L, M, N, O, P and Q. The B-format is defined up to the third HOA order only. For the transmission of the horizontal (2D) coefficients the supplemental 3D coefficients are ignored, e.g. W, X, Y, U, V, P, Q.

The coefficients $C_n^m$ for 3D HOA are transmitted in TrackHOAParamCoeffSequence in a numerically upward or downward manner from the lowest to the highest HOA order (n=0 . . . N).

The numerical upward sequence starts with m=−n and increases to m=n ($C_0^0, C_1^{-1}, C_1^0, C_1^1, C_2^{-2}, C_2^{-1}, C_2^0, C_2^1, C_2^2, \ldots$), which is the 'CG' sequence defined in Chris Travis, "Four candidate component sequences", http://ambisonics-.googlegroups.com/web/Four+candidate+component+sequences+V09.pdf, 2008. The numerical downward sequence m runs the other way around from m=n to m=−n($C_0^0, C_1^1, C_1^0, C_1^{-1}, C_2^2, C_2^1, C_2^0, C_2^{-1}, C_2^{-2}, \ldots$) which is the 'QM' sequence defined in that publication.

For 2D HOA coefficients the TrackHOAParamCoeffSequence numerical upward and downward sequences are like in the 3D case, but wherein the unused coefficients with $|m| \neq n$ (i.e. only the sectoral HOA coefficients $C_{|m|}^m = C_m$ of Table 10) are omitted. Thus, the numerical upward sequence leads to ($C_0^0, C_1^{-1}, C_1^1, C_2^{-2}, C_2^2, \ldots$) and the numerical downward sequence to ($C_0^0, C_1^1, C_1^{-1}, C_2^2, C_2^{-2}, \ldots$).

Track Packets

HOA Track Packets

PCM Coding Type Packet

| Field Name | Size/ Bit | Data Type | Description |
|---|---|---|---|
| <PacketHOACoeffs> | dyn | dyn | Channel interleaved HOA coefficients stored in TrackSampleFormat and TrackHOAParamCoeffSequence, e.g. <[W(0), X(0), Y(0), S(0)], [W(1), X(1), Y(1), S(1)], . . . , S(FrameNumberOfSamples − 1)]> |

This Packet contains the HOA coefficients $C_n^m$ in the order defined in the TrackHOAParamCoeffSequence, wherein all coefficients of one time sample are transmitted successively.

This Packet is used for standard HOA Tracks with a TrackSourceType of zero and a TrackCodingType of zero.

Dynamic Resolution Coding Type Packet

| Field Name | Size/ Bit | Data Type | Description |
|---|---|---|---|
| <PacketHOACoeffsCoded> | dyn | dyn | Channel de-interleaved HOA coefficients stored according to the TrackCodingType, e.g. <[W(0), W(1), W(2), . . .], [X(0), X(1), X(2), . . .], [Y(0), Y(1), Y(2), . . .], [S(0), S(1), S(2), . . .]> |

The dynamic resolution package is used for a TrackSourceType of 'zero' and a TrackCodingType of 'one'. The different resolutions of the TrackOrderRegions lead to different storage sizes for each TrackOrderRegion. Therefore, the HOA coefficients are stored in a de-interleaved manner, e.g. all coefficients of one HOA order are stored successively.

Single Source Track Packets

Single Source fixed Position Packet

| Field Name | Size/ Bit | Data Type | Description |
|---|---|---|---|
| <PacketMonoPCMTrack> | dyn | dyn | PCM samples of the single audio source stored in TrackSampleFormat |

The Single Source fixed Position Packet is used for a TrackSourceType of 'one' and a TrackMovingSourceFlag of 'zero'. The Packet holds the PCM samples of a mono source.

Single Source Moving Position Packet

| Field Name | Size/ Bit | Data Type | Description |
|---|---|---|---|
| PacketDirectionFlag | 1 | binary | Set to '1' if the direction has been changed. '1' is mandatory for the first Packet of a frame. |
| reserved | 7 | binary | fill bits |
| Condition: PacketDirectionFlag == '1' | | | new position data follows |
| Condition: TrackPositionType == '0' | | | Position TrackPostionVector as angle TrackPostionVector |
| theta | 32 | float32 | inclination in rad [0 . . . pi] |
| phi | 32 | float32 | azimuth (counter-clockwise) in rad [0 . . . 2pi] |
| radius | 32 | float32 | Distance from reference point in meter |
| Condition: TrackPositionType == '1' | | | Position as HOA encoding vector |
| Condition: TrackEncodeVectorFormat == '0' | | | encoding vector as float32 |
| <TrackHOAEncodingVector> | dyn | float32 | TrackHOAParamNumberOfCoeffs entries of the HOA encoding vector in TrackHOAParamCoeffSequence order |
| Condition: TrackEncodeVectorFormat == '1' | | | encoding vector as float64 |
| <TrackHOAEncodingVector> | dyn | float64 | TrackHOAParamNumberOfCoeffs entries of the HOA encoding vector in TrackHOAParamCoeffSequence order |
| <PacketMonoPCMTrack> | dyn | dyn | PCM samples of the single audio source stored in TrackSampleFormat |

The Single Source moving Position Packet is used for a TrackSourceType of 'one' and a TrackMovingSourceFlag of 'one'. It holds the mono PCM samples and the position information for the sample of the TrackPacket.

The PacketDirectionFlag indicates if the direction of the Packet has been changed or the direction of the previous Packet should be used. To ensure decoding from the beginning of each Frame, the PacketDirectionFlag equals 'one' for the first moving source TrackPacket of a Frame.

For a PacketDirectionFlag of 'one' the direction information of the following PCM sample source is transmitted. Dependent on the TrackPositionType, the direction information is sent as TrackPositionVector in spherical coordinates or as TrackHOAEncodingVector with the defined TrackEncodingVectorFormat. The TrackEncodingVector generates HOA Coefficients that are conforming to the HOAParamHeader field definitions. Successively to the directional information the PCM mono Samples of the TrackPacket are transmitted.

Coding Processing

TrackRegion Coding

HOA signals can be derived from Soundfield recordings with microphone arrays. For example, the Eigenmike disclosed in WO 03/061336 A1 can be used for obtaining HOA recordings of order three. However, the finite size of the microphone arrays leads to restrictions for the recorded HOA coefficients. In WO 03/061336 A1 and in the above-mentioned article "Three-dimensional surround sound systems based on spherical harmonics" issues caused by finite microphone arrays are discussed.

The distance of the microphone capsules results in an upper frequency boundary given by the spatial sampling theorem.

Above this upper frequency the microphone array can not produce correct HOA coefficients. Furthermore the finite distance of the microphone from the HOA listening position requires an equalisation filter. These filters obtain high gains for low frequencies which even increase with each HOA order. In WO 03/061336 A1 a lower cut-off frequency for the higher order coefficients is introduced in order to handle the dynamic range of the equalisation filter. This shows that the bandwidth of HOA coefficients of different HOA orders can differ. Therefore the HOA file format offers the TrackRegionBandwidthReduction that enables the transmission of only the required frequency bandwidth for each HOA order. Due to the high dynamic range of the equalisation filter and due to the fact that the zero order coefficient is basically the sum of all microphone signals, the coefficients of different HOA orders can have different dynamical ranges. Therefore the HOA file format offers also the feature of adapting the format type to the dynamic range of each HOA order.

TrackRegion Encoding Processing

As shown in FIG. 12, the interleaved HOA coefficients are fed into the first de-interleaving step or stage 1211, which is assigned to the first TrackRegion and separates all HOA coefficients of the TrackRegion into de-interleaved buffers to FramePacketSize samples. The coefficients of the TrackRegion are derived from the TrackRegionLastOrder and TrackRegionFirstOrder field of the HOA Track Header. De-interleaving means that coefficients $C_n^m$ for one combination of n and m are grouped into one buffer. From the de-interleaving step or stage 1211 the de-interleaved HOA coefficients are passed to the TrackRegion encoding section. The remaining interleaved HOA coefficients are passed to the following TrackRegion de-interleave step or stage, and so on until deinterleaving step or stage 121N. The number N of deinterleaving steps or stages is equal to TrackNumberOfOrderRegions plus 'one'. The additional de-interleaving step or stage 125 de-interleaves the remaining coefficients that are not part of the TrackRegion into a standard processing path including a format conversion step or stage 126.

The TrackRegion encoding path includes an optional bandwidth reduction step or stage 1221 and a format conversion step or stage 1231 and performs a parallel processing for each HOA coefficient buffer. The bandwidth reduction is performed if the TrackRegionUseBandwidthReduction field is set to 'one'. Depending on the selected TrackBandwidthReductionType a processing is selected for limiting the frequency range of the HOA coefficients and for critically downsampling them. This is performed in order to reduce the number of HOA coefficients to the minimum required number of samples. The format conversion converts the current HOA coefficient format to the TrackRegionSampleFormat defined in the HOATrack header. This is the only step/stage in the standard processing path that converts the HOA coefficients to the indicated TrackSampleFormat of the HOA Track Header.

The multiplexer TrackPacket step or stage 124 multiplexes the HOA coefficient buffers into the TrackPacket data file stream as defined in the selected TrackHOAParamCoeffSequence field, wherein the coefficients $C_n^m$ for one combination of n and m indices stay de-interleaved (within one buffer).

TrackRegion Decoding Processing

As shown in FIG. 13, the decoding processing is inverse to the encoding processing. The de-multiplexer step or stage 134 de-multiplexes the TrackPacket data file or stream from the indicated TrackHOAParamCoeffSequence into de-interleaved HOA coefficient buffers (not depicted). Each buffer contains FramePacketLength coefficients $C_n^m$ for one combination of n and m.

Step/stage 134 initialises TrackNumberOfOrderRegion plus 'one' processing paths and passes the content of the deinterleaved HOA coefficient buffers to the appropriate processing path. The coefficients of each TrackRegion are defined by the TrackRegionLastOrder and TrackRegionFirstOrder fields of the HOA Track Header. HOA orders that are not covered by the selected TrackRegions are processed in the standard processing path including a format conversion step or stage 136 and a remaining coefficients interleaving step or stage 135. The standard processing path corresponds to a TrackProcessing path without a bandwidth reduction step or stage.

In the TrackProcessing paths, a format conversion step/stage 1331 to 133N converts the HOA coefficients that are encoded in the TrackRegionSampleFormat into the data format that is used for the processing of the decoder. Depending on the TrackRegionUseBandwidthReduction data field, an optional bandwidth reconstruction step or stage 1321 to 132N follows in which the band limited and critically sampled HOA coefficients are reconstructed to the full bandwidth of the Track. The kind of reconstruction processing is defined in the TrackBandwidthReductionType field of the HOA Track Header. In the following interleaving step or stage 1311 to 131N the content of the de-interleaved buffers of HOA coefficients are interleaved by grouping HOA coefficients of one time sample, and the HOA coefficients of the current TrackRegion are combined with the HOA coefficients of the previous TrackRegions. The resulting sequence of the HOA coefficients can be adapted to the processing of the Track. Furthermore, the interleaving steps/stages deal with the delays between the TrackRegions using bandwidth reduction and TrackRegions not using bandwidth reduction, which delay depends on the selected TrackBandwidthReductionType processing. For example, the MDCT processing adds a delay of FramePacketSize samples and therefore the interleaving steps/stages of processing paths without bandwidth reduction will delay their output by one packet.

Bandwidth Reduction Via MDCT

Encoding

FIG. 14 shows bandwidth reduction using MDCT (modified discrete cosine transform) processing. Each HOA coefficient of the TrackRegion of FramePacketSize samples passes via a buffer 1411 to 141M a corresponding MDCT window adding step or stage 1421 to 142M. Each input buffer contains the temporal successive HOA coefficients $C_n^m$ of one combination of n and m, i.e., one buffer is defined as (buffer $$(\text{buffer})C_n^m=[C_n^m(0),C_n^m(1),\ldots,C_n^m(FramePacketSize-1)].$$

The number M of buffers is the same as the number of Ambisonics components ($(N+1)^2$ for a full 3D sound field of order N). The buffer handling performs a 50% overlap for the following MDCT processing by combining the previous buffer content with the current buffer content into a new content for the MDCT processing in corresponding steps or stages 1431 to 143M, and it stores the current buffer content for the processing of the following buffer content. The MDCT processing re-starts at the beginning of each Frame, which means that all coefficients of a Track of the current Frame can be decoded without knowledge of the previous Frame, and following the last buffer content of the current Frame an additional buffer content of zeros is processed. Therefore the MDCT processed TrackRegions produce one extra TrackPacket. In the window adding steps/stages the corresponding buffer content is multiplied with the selected window function w(t), which is defined in the HOATrack header field TrackRegionWindowType for each TrackRegion.

The Modified Discrete Cosine Transform is first mentioned in J. P. Princen, A. B. Bradley, "Analysis/Synthesis Filter Bank Design Based on Time Domain Aliasing Cancellation", *IEEE Transactions on Acoustics, Speech and Signal Processing*, vol. ASSP-34, no. 5, pages 1153-1161, October 1986. The MDCT can be considered as representing a critically sampled filter bank of FramePacketSize subbands, and it requires a 50% input buffer overlap. The input buffer has a length of twice the subband size. The MDCT is defined by the following equation with T equal to FramePacketSize:

$$C_n^m(k) = \sum_{t=0}^{2T-1} w(t)C_n^m(t)\cos\left[\frac{\pi}{T}\left(t+\frac{T+1}{2}\right)\left(k+\frac{1}{2}\right)\right] \text{ for } 0 \le k < T$$

The coefficients $C'_n{}^m(k)$ are called MDCT bins. The MDCT computation can be implemented using the Fast Fourier Transform. In the following frequency region cut-out step or stages 1441 to 144M the bandwidth reduction is performed by removing all MDCT bins $C'_n{}^m(k)$ with k<TrackRegionFirstBin and k>TrackRegionLastBin, for the reduction of the buffer length to TrackRegionLastBin−TrackRegionFirstBin+1, wherein TrackRegionFirstBin is the lower cut-off frequency for the TrackRegion and TrackRegionLastBin is the upper cut-off frequency. The neglecting of MDCT bins can be regarded as representing a bandpass filter with cut-off frequencies corresponding to the TrackRegionLastBin and TrackRegionFirstBin frequencies. Therefore only the MDCT bins required are transmitted.

Decoding

FIG. 15 shows bandwidth decoding or reconstruction using MDCT processing, in which HOA coefficients of bandwidth limited TrackRegions are reconstructed to the full bandwidths of the Track. This bandwidth reconstruction processes buffer content of temporally de-interleaved HOA coefficients in parallel, wherein each buffer contains TrackRegionLastBin−TrackRegionFirstBin+1 MDCT bins of coefficients $C'_n{}^m(k)$. The missing frequency regions adding steps or stages 1541 to 154M reconstruct the complete MDCT buffer content of size FramePacketLength by complementing the received MDCT bins with the missing MDCT bins k<TrackRegionFirstBin and k>TrackRegionLastBin using zeros. Thereafter the inverse MDCT is performed in corresponding inverse MDCT steps or stages 1531 to 153M in order to reconstruct the time domain HOA coefficients $C_n^m(t)$. Inverse MDCT can be interpreted as a synthesis filter bank wherein FramePacketLength MDCT bins are converted to two times FramePacketLength time domain coefficients. However, the complete reconstruction of the time domain samples requires a multiplication with the window function w(t) used in the encoder and an overlap-add of the first half of the current buffer content with the second half of the previous buffer content. The inverse MDCT is defined by the following equation:

$$C_n^m(t) = \frac{w(t)}{2T}\sum_{t=0}^{T-1} C_n^m(k)\cos\left[\frac{\pi}{T}\left(t+\frac{T+1}{2}\right)\left(k+\frac{1}{2}\right)\right] \text{ for } 0 \le t < T$$

Like the MDCT, the inverse MDCT can be implemented using the inverse Fast Fourier Transform.

The MDCT window adding steps or stages 1521 to 152M multiply the reconstructed time domain coefficients with the window function defined by the TrackRegionWindowType. The following buffers 1511 to 151M add the first half of the current TrackPacket buffer content to the second half of the last TrackPacket buffer content in order to reconstruct FramePacketSize time domain coefficients. The second half of the current TrackPacket buffer content is stored for the processing of the following TrackPacket, which overlap-add processing removes the contrary aliasing components of both buffer contents.

For multi-Frame HOA files the encoder is prohibited to use the last buffer content of the previous frame for the overlap-add procedure at the beginning of a new Frame. Therefore at Frame borders or at the beginning of a new Frame the overlap-add buffer content is missing, and the reconstruction of the first TrackPacket of a Frame can be performed at the second TrackPacket, whereby a delay of one FramePacket and decoding of one extra TrackPacket is introduced as compared to the processing paths without bandwidth reduction. This delay is handled by the interleaving steps/stages described in connection with FIG. 13.

The invention claimed is:

1. A non-transitory machine readable medium containing a data structure for Higher Order Ambisonics (HOA) audio data including Ambisonics coefficients, which data structure includes 2D, or 3D, or both 2D and 3D, spatial audio content data for one or more different HOA audio data stream descriptions, and which data structure is also suited for HOA audio data that have on order of greater than '3', and which data structure in addition can include single audio signal source data, or microphone array audio data, or both single audio signal source data and microphone array audio data, from fixed or time-varying spatial positions, wherein said different HOA audio data stream descriptions are related to at least two of different loudspeaker position densities, coded HOA wave types, HOA orders and HOA dimensionality, and wherein one HOA audio data stream description contains audio data for a presentation with a given loudspeaker arrangement located at a distinct area of a presentation site, and another HOA audio data stream description contains audio data for a presentation with a different loudspeaker arrangement surrounding said presentation site, wherein said different loudspeaker arrangement has a loudspeaker position density that is lower than that of said given loudspeaker arrangement.

2. The medium according to claim 1, wherein said audio data for said given loudspeaker arrangement represent sphere waves and a first Ambisonics order, and said audio data for said different loudspeaker arrangement represent plane waves, or a second Ambisonics order, or both plane waves and a second Ambisonics order, wherein said second Ambisonics order is smaller than said first Ambisonics order.

3. The medium according to claim 1, wherein said data structure serves as scene description where tracks of an audio scene can start and end at any time.

4. The medium according to claim 1, wherein said data structure includes data items regarding one or more of a:

region of interest related to audio sources outside or inside a listening area;

normalization of spherical basis functions;

propagation directivity;

Ambisonics coefficient scaling information;

Ambisonics wave type, including a plane or spherical type;

in case of spherical waves, reference radius for decoding.

5. The medium according to claim 1, wherein said Ambisonics coefficients are complex coefficients.

6. The medium according to claim 1, wherein said data structure includes at least one of a metadata regarding the directions and characteristics for one or more microphones, and an encoding vector for single-source input signals.

7. The medium according to claim 1, wherein at least part of said Ambisonics coefficients are bandwidth-reduced, so that for different HOA orders the bandwidth of the related Ambisonics coefficients is different.

8. The medium according to claim 7, wherein said bandwidth reduction is based on modified discrete cosine transform (MDCT) processing.

9. The medium according to claim 1, wherein said presentation site is a listening or seating area in a cinema.

10. Method for encoding and arranging data for a data structure contained in a medium according to claim 1.

11. Method for audio presentation, comprising:

receiving a Higher Order Ambisonics (HOA) audio data stream containing at least two different HOA audio data signals, wherein at least a first one of the signals is used for presentation with a given loudspeaker arrangement located at a distinct area of a presentation site, and wherein at least a second and different one of the signals is used for presentation with a different loudspeaker arrangement surrounding said presentation site, wherein said different loudspeaker arrangement has a loudspeaker position density that is lower than that of said given loudspeaker arrangement.

12. Method according to claim 11, wherein said audio data for said given loudspeaker arrangement represent sphere waves and a first Ambisonics order, and said audio data for said different loudspeaker arrangement represent plane waves, or a second Ambisonics order, or both plane waves and a second Ambisonics order, wherein said second Ambisonics order is smaller than said first Ambisonics order.

13. Method according to claim 11, wherein said presentation site is a listening or seating area in a cinema.

14. Apparatus for audio presentation, comprising:

means for receiving a Higher Order Ambisonics (HOA) audio data stream containing at least two different HOA audio data signals;

means for processing at least a first one of the signals for presentation with a given loudspeaker arrangement located at a distinct area of a presentation site; and means for processing a second and different one of the signals for presentation with a different loudspeaker arrangement surrounding said presentation site, wherein said different loudspeaker arrangement has a loudspeaker position density that is lower than that of said given loudspeaker arrangement.

* * * * *